US008777384B2

(12) United States Patent
Mizuno

(10) Patent No.: US 8,777,384 B2
(45) Date of Patent: Jul. 15, 2014

(54) INK CARTRIDGE AND PRINTING SYSTEM

(75) Inventor: Naoki Mizuno, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 172 days.

(21) Appl. No.: 13/530,462

(22) Filed: Jun. 22, 2012

(65) Prior Publication Data

US 2012/0327146 A1 Dec. 27, 2012

(30) Foreign Application Priority Data

Jun. 24, 2011 (JP) ..... 2011-140604

(51) Int. Cl.
*B41J 2/175* (2006.01)
*B41J 2/195* (2006.01)
*B41J 2/17* (2006.01)

(52) U.S. Cl.
USPC ..... 347/86; 347/7; 347/84; 347/85

(58) Field of Classification Search
CPC ..... B41J 2/17513; B41J 2/17553; B41J 2/17566; B41J 2/17503
USPC ..... 347/7, 84, 85, 86
See application file for complete search history.

(56) References Cited

U.S. PATENT DOCUMENTS 6,609,789 B1 * 8/2003 Hunt ..... 347/86
7,216,963 B2 * 5/2007 Takagi ..... 347/86

FOREIGN PATENT DOCUMENTS

JP 2011000751 A 1/2011

* cited by examiner

*Primary Examiner* — Jannelle M Lebron
(74) *Attorney, Agent, or Firm* — Fox Rothschild LLP

(57) ABSTRACT

This disclosure discloses an ink cartridge comprises a housing; a reservoir portion disposed so that an end portion on one side in a thickness direction contacts the housing; a detection plate that is supported with respect to the housing at a lower end portion, comes in contact with the other side of the reservoir portion in the thickness direction, and rotates in accordance with an ink volume, thereby executing a display in accordance with the ink volume by that rotational position; and a collapse prevention rib that creates a predetermined gap between an end portion on one side in the thickness direction and a left wall portion of the housing, extends above the detection plate, and causes the upper portion of the reservoir portion to be inserted through the gap, thereby suppressing the displacement of the reservoir portion to the other side in the thickness direction.

8 Claims, 22 Drawing Sheets

FIG. 16A
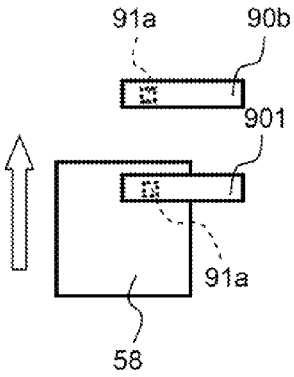
FIG. 16B
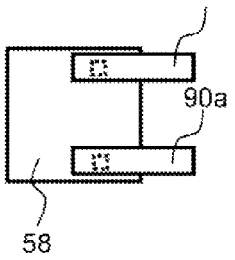
FIG. 16C
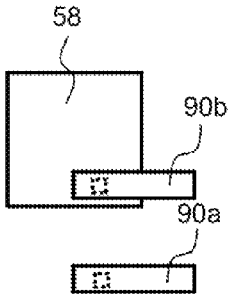
FIG. 16D
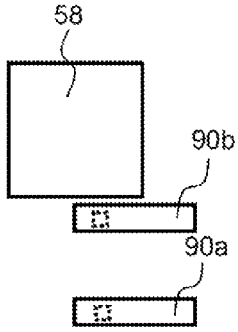
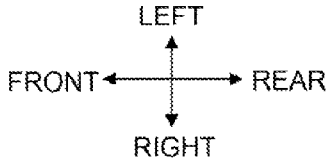
FIG. 16E
| | | | | |
|---|---|---|---|---|
| FIRST SENSOR | × | × | ○ | ○ |
| SECOND SENSOR | ○ | × | × | ○ |
| INK VOLUME | FULL | SUFFI-CIENT | CLOSE TO EMPTY | EMPTY |

UP
LEFT
RIGHT
DOWN 1
2
80
82
71a
58
50
71
54a, 54b
336

1
2
80
71a
71a
50
71
54a, 54b 1
2
80
71a
71a
50
71
54a, 54b

INK CARTRIDGE AND PRINTING SYSTEM

CROSS-REFERENCE TO RELATED APPLICATION

The present application claims priority from Japanese Patent Application No. 2011-140604, which was filed on Jun. 24, 2011, the disclosure of which is incorporated herein by reference in its entirety.

BACKGROUND OF THE INVENTION

1. Field of the Invention

The present invention relates to an ink cartridge that contains ink, and a printing system.

2. Description of the Related Art

Ink cartridges that are generally known comprise an ink bag that contains ink in its interior, a plug for extracting the contained ink from the ink bag, and a rectangular parallelepiped-shaped plastic case configured to house the ink bag.

The ink cartridge of the above-described prior art reference is provided with an opening on the housing. A needle that pierces into the rubber stopper of the plug and introduces the ink within the reservoir portion passes through the opening. While the plug can be visually checked from this opening, visually checking the volume of ink within the reservoir portion is difficult.

SUMMARY OF THE INVENTION

It is therefore an object of the present invention to provide an ink cartridge capable of accurately displaying the ink volume within the reservoir portion by a rotational position of a rotating member, regardless if the ink volume within the reservoir portion is high or low, and a printing system that uses the same.

Means for Solving the Problems

In order to achieve the above-described object, according to the first invention, there is provided an ink cartridge comprising: a housing having a longwise direction, a shortwise direction orthogonal to the longwise direction, and a thickness direction respectively orthogonal to the longwise direction and the shortwise direction; and a substantially bag-shaped reservoir portion configured to store ink in its interior, disposed within the housing so that an end portion on one side in the thickness direction contacts the housing; wherein: the ink cartridge is for supplying the ink and is used in a posture where the longwise direction and the thickness direction are substantially horizontal, and the shortwise direction is substantially vertical; the ink cartridge further comprising: a rotating member that is rotatably supported with respect to the housing at a lower end portion, comes in contact with the other side of the reservoir portion in the thickness direction, and rotates in accordance with an ink volume within the reservoir portion, thus executing a display in accordance with the ink volume by that rotational position; and a displacement suppressing portion that creates a predetermined gap between the end portion on the one side in the thickness direction and a lateral surface on one side of the housing in the thickness direction and extends above the rotating member, causing an upper portion of the reservoir portion to be inserted through the gap, thereby suppressing displacement of the reservoir portion to the other side in the thickness direction.

The ink cartridge according to the first aspect of the present invention is used with the longwise direction and thickness direction of the housing substantially horizontal, and the shortwise direction substantially vertical. A bag-shaped reservoir portion is provided in the housing interior, and this reservoir portion stores ink. The reservoir portion is bag shaped and disposed so that an end portion of one side in the thickness direction contacts the housing. A rotating member rotatably supported by a lower end portion comes in contact with the other side of this reservoir portion in the thickness direction. The reservoir portion is formed so that it bulges on the other side in the above-described thickness direction when the volume of ink within its interior is high. With this arrangement, the rotating member rotates in accordance with the ink volume within the reservoir portion interior by the above-described contact. As a result, changes in the ink volume are displayed by the rotational position of this rotating member.

When the volume of ink within the above-described bag-shaped reservoir portion decreases, the liquid level decreases. In this case, the upper portion of the reservoir portion which has become empty may collapse on the other side in the above-described thickness direction and hang downward due to the elasticity of the bag. In such a case, the collapsed upper portion may contact the rotating member, etc., causing the display of ink volume by the above-described rotational position of the rotating member associated with the ink volume to become inaccurate.

Here, according to the first aspect of the present invention, a displacement suppressing portion is provided above the rotating member. An end portion on one side of this displacement suppressing portion in the thickness direction forms a predetermined gap with the lateral surface of one side of the housing in the thickness direction. The upper portion of the above-described reservoir portion is inserted through this gap. With this arrangement, even in a case where the upper portion of the reservoir portion collapses on the other side in the thickness direction and downward as described above, it is possible to suppress the displacement of the reservoir portion to the other side in the thickness direction. At this time, the reservoir portion does not become caught and fixed between the displacement suppressing portion and housing, but rather is inserted through the gap. With this arrangement, the bulging behavior toward the other side of the reservoir portion in the above-described thickness direction in a case where ink of a relatively high volume exists within the reservoir portion and the ink level is high is not inhibited. As a result, it is possible to ensure smooth bulging.

As a result of the above, in both cases where the ink volume within the reservoir portion is high and where it is low, the rotating member can accurately display the ink volume by its rotational position associated with the ink volume.

In order to achieve the above-described object, according to the ninth invention, there is provided a printing system comprising: an ink cartridge configured to supply ink, comprising a housing that has a longwise direction, a shortwise direction orthogonal to the longwise direction, and a thickness direction respectively orthogonal to the longwise direction and the shortwise direction, and used in a posture in which the longwise direction and the thickness direction are substantially horizontal and the shortwise direction is substantially vertical; and a printer comprising a printhead that discharges ink supplied from the ink cartridge onto a medium to be record; wherein the ink cartridge further comprises: a substantially bag-shaped reservoir portion configured to store ink in its interior, disposed within the housing so that an end portion on one side in the thickness direction contacts the housing; a detected member that is rotatably supported with respect to the housing at a lower end portion, comes in contact with the other side of the reservoir portion in the thickness direction, and rotates in accordance with an ink volume within the reservoir portion; and a displacement suppressing portion that creates a predetermined gap between the end portion on the one side in the thickness direction and a lateral surface on one side of the housing in the thickness direction and extends above the detected member, causing an upper portion of the reservoir portion to be inserted through the gap, thereby suppressing displacement of the reservoir portion to the other side in the thickness direction; and the printer further comprises: a detection device configured to detect a rotational position of the detected member; a determination portion configured to determine an ink volume within the reservoir portion based on a detection result of the detection device; and a control device configured to execute control in relation to at least one of notification and print prevention in a form corresponding to a determination result of the determination portion.

The ink cartridge of the printing system according to the ninth aspect of the present invention is used with the longwise direction and thickness direction of the housing substantially horizontal, and the shortwise direction substantially vertical. A bag-shaped reservoir portion is provided in the housing interior, and this reservoir portion stores ink. The reservoir portion is bag shaped and disposed so that an end portion of one side in the thickness direction contacts the housing. A rotating member rotatably supported by a lower end portion comes in contact with the other side of this reservoir portion in the thickness direction. The reservoir portion is formed so that it bulges on the other side in the above-described thickness direction, that is, the other side in the substantially horizontal direction, proportionately to the high volume of ink within its interior. With this arrangement, the rotating member rotates in accordance with the ink volume within the reservoir portion by the above-described contact. The rotational position of this rotating member is detected by a detection device of the printer. As a result, the change in the ink volume within the reservoir portion is determined by the determination portion of the printer, making it possible to issue notification or prohibit printing in accordance with the ink volume, based on the control of the control device.

When the volume of ink within the above-described bag-shaped reservoir portion decreases, the liquid level decreases. In this case, the upper portion of the reservoir portion which has become empty may collapse on the other side in the above-described thickness direction or hang downward due to the elasticity of the bag. In such a case, the collapsed upper portion may contact the rotating member, etc., causing the temperature relationship between the above-described ink volume within the reservoir portion and the rotational position of the above-described rotating member to become inaccurate.

Here, according to the ninth aspect of the present invention, a displacement suppressing portion is provided above the rotating member. An end portion on one side of this displacement suppressing portion in the thickness direction forms a predetermined gap with the lateral surface of one side of the housing in the thickness direction. The upper portion of the above-described reservoir portion is inserted through this gap. With this arrangement, even in a case where the upper portion of the reservoir portion collapses on the other side in the thickness direction and downward as described above, it is possible to suppress the displacement of the reservoir portion to the other side in the thickness direction. At this time, the reservoir portion does not become caught and fixed between the displacement suppressing portion and housing, but rather is inserted through the gap. With this arrangement, the bulging behavior toward the other side of the reservoir portion in the above-described thickness direction in a case where ink of a relatively high volume exists within the reservoir portion and the ink level is high is not inhibited. As a result, it is possible to ensure smooth bulging.

With the arrangement above, in both cases where the ink volume within the reservoir portion is high and where it is low, the rotating member can achieve a rotational position that accurately corresponds to the ink volume. As a result, it is possible to accurately control the above-described notification and prohibition of printing in accordance with the ink volume on the printer side.

BRIEF DESCRIPTION OF THE DRAWINGS

FIG. 16A is a figure showing the ink volume detection method by the optical sensor.

FIG. 16B is a figure showing the ink volume detection method by the optical sensor.

FIG. 16C is a figure showing the ink volume detection method by the optical sensor.

FIG. 16D is a figure showing the ink volume detection method by the optical sensor.

FIG. 16E is a table showing the ink volume determination method based on the detection result of the optical sensor.

DETAILED DESCRIPTION OF PREFERRED EMBODIMENTS

The following describes an embodiment of the present invention with reference to accompanying drawings.

Printer Overview

Figure 1:
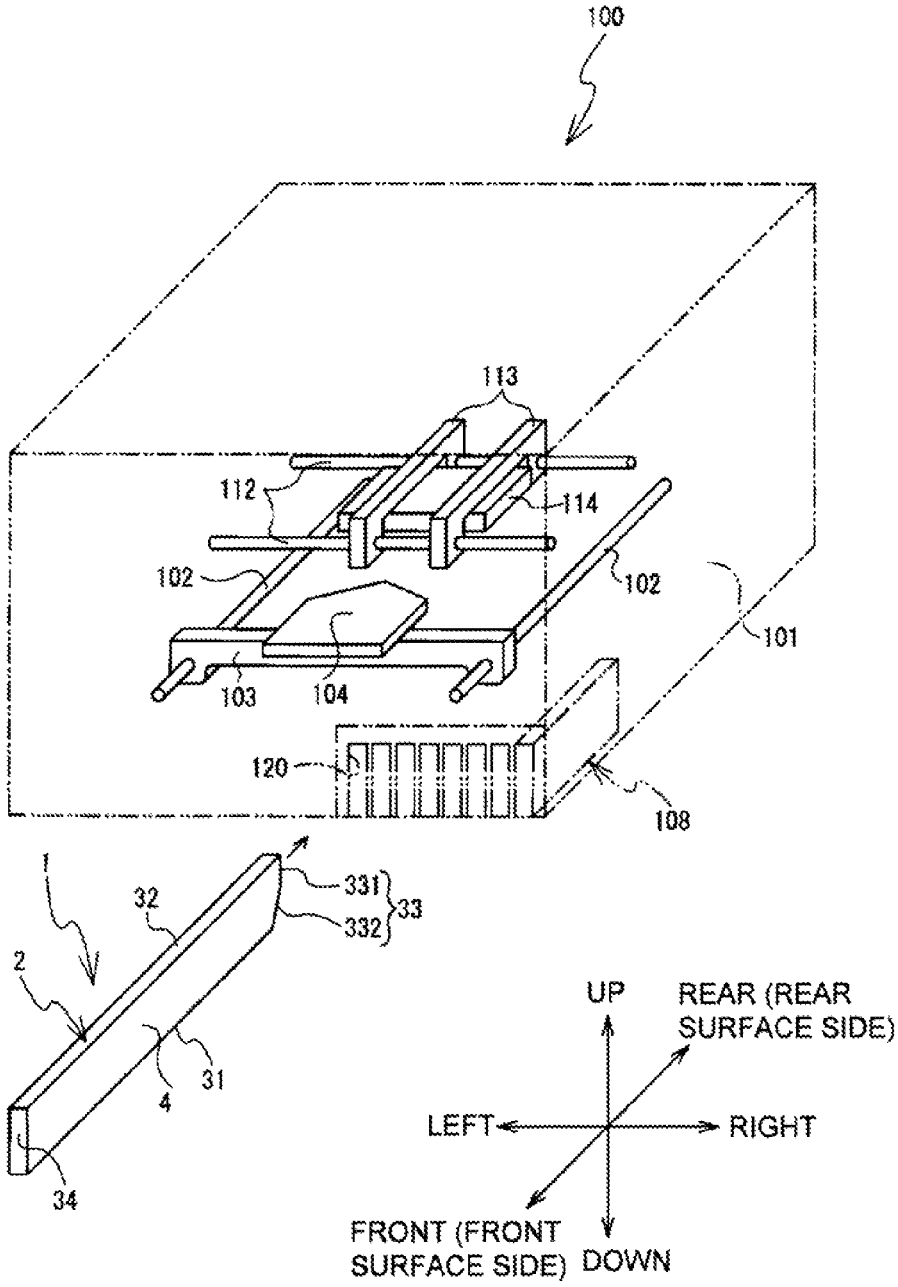
FIG. 1 is a perspective view showing the general configuration of the printer to which the ink cartridge of one embodiment of the present invention is applied, as viewed from the front.

The following describes the printer used in this embodiment, using FIG. 1. Note that, in the following description, the vertical (up/down) direction, front-rear direction, and horizontal (right/left) direction correspond to the directions of the arrows suitably shown in each figure. As shown in FIG. 1, a printer 100 used in this embodiment is an inkjet printer that uses ink supplied from an ink cartridge 1 and performs printing on fabric such as a T-shirt, for example, via a printhead 114.

This printer 100 comprises a platen 104, the above-described printhead 114, a carriage 113, a pair of guide bars 112, and a carriage drive mechanism within a box-shaped housing 101.

The platen 104 sets and horizontally supports the fabric (not shown). The printhead 114 discharges ink supplied from the ink cartridge 1 onto the fabric supported by the platen 104, printing letters, images, etc., on the fabric. The carriage 113 holds the printhead 114 and moves the printhead 114 back and forth to the left side and the right side in FIG. 1. The guide bars 112 guide the carriage 113 horizontally. The carriage drive mechanism includes a carriage drive motor (not shown) that drives the carriage 113 along the guide bars 112.

Eight cartridge mounting portions 108 that extend in the front-rear direction are provided to a lower location near the front right of the housing 101. A cartridge insertion port 120 of each of the cartridge mounting portions 108 opens on the front of the housing 101. Note that FIG. 1 shows only one of the cartridge mounting portions 108 and one of the cartridge insertion ports 120 to avoid complexities in illustration. The length of the cartridge mounting portion 108 is, for example, about one-third of the length of the ink cartridge 1. The ink cartridge 1 is mounted to the cartridge mounting portion 108, and thus inserted inside the printer 100 in a state that enables ink supply. Then, the ink is supplied from the ink cartridge 1 to the printhead 114 via a tube within the printer 100. The eight ink cartridges 1 comprise, for example, four white ink cartridges, one cyan ink cartridge, one magenta ink cartridge, one yellow ink cartridge, and one black ink cartridge.

Ink Cartridge

Figure 2:
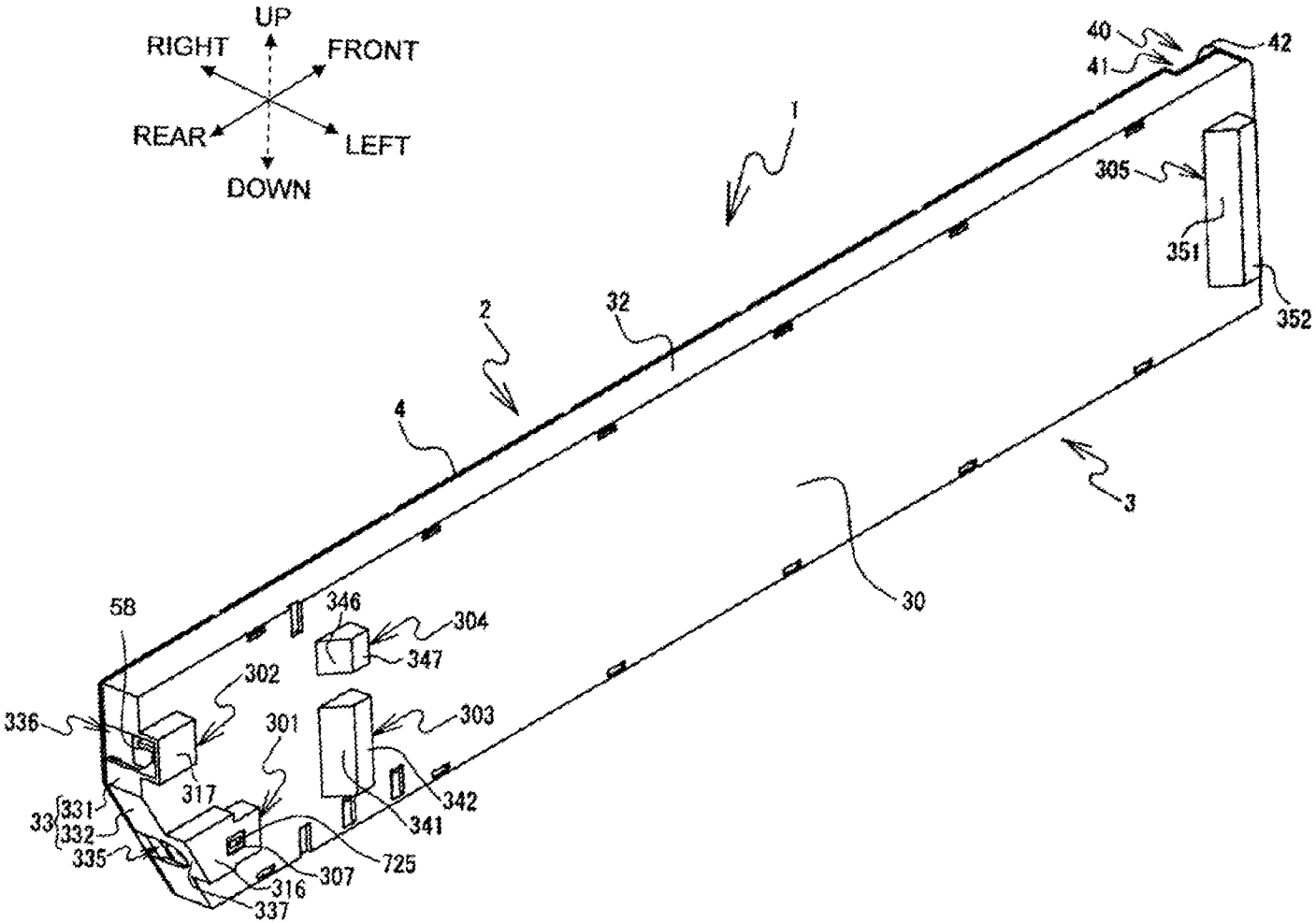
FIG. 2 is a perspective view showing the outer appearance of the ink cartridge of one embodiment of the present invention, as viewed from the rear.
Figure 3:
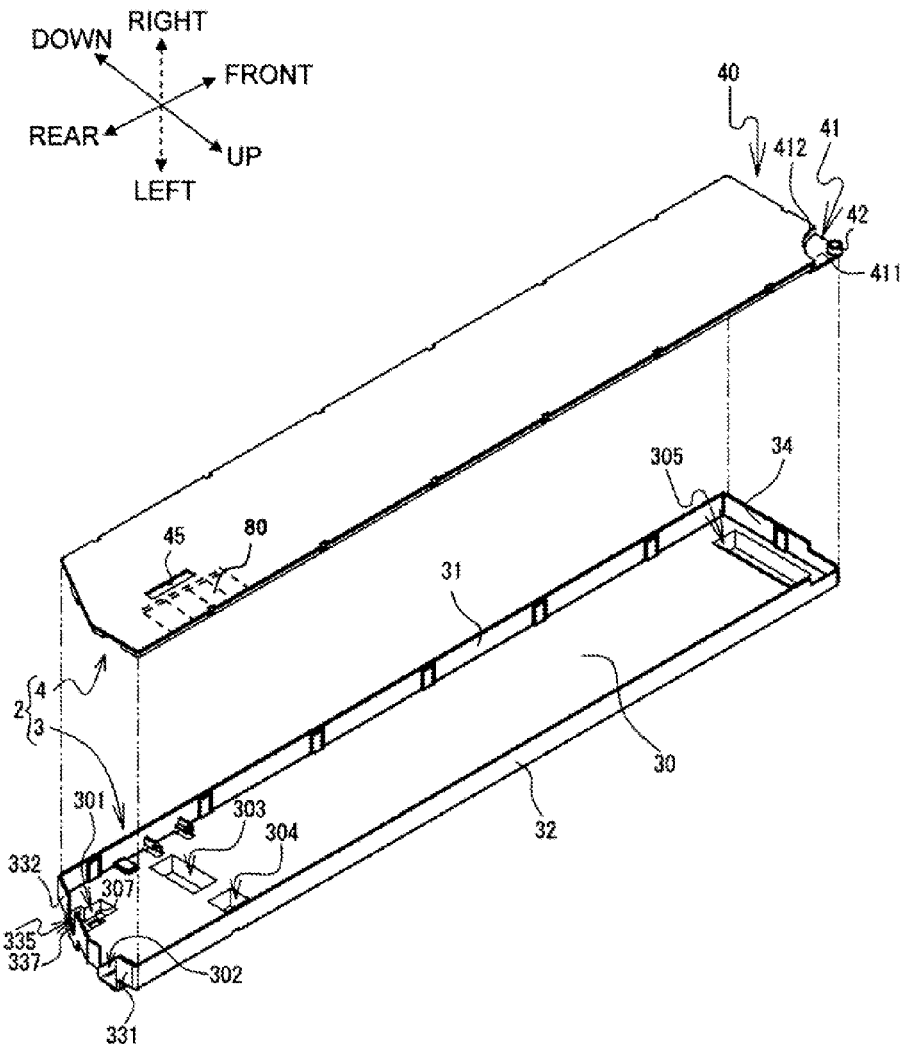
FIG. 3 is an exploded perspective view of the housing of the ink cartridge.
Figure 4:
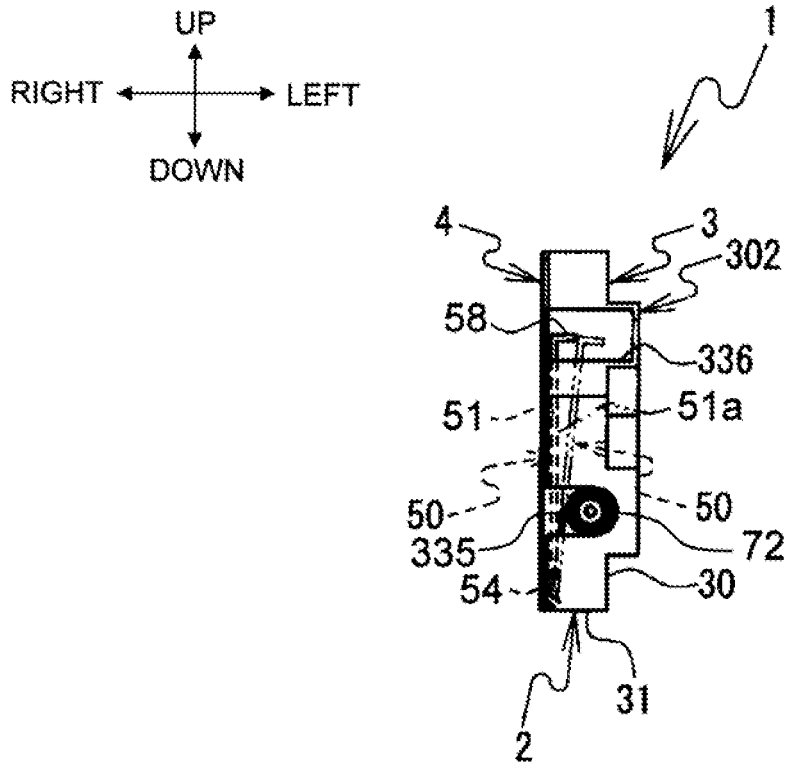
FIG. 4 is a rear view of the ink cartridge.

The following describes the overall configuration of the ink cartridge 1, using FIG. 2 to FIG. 6. As shown in FIG. 2 to FIG. 4, in this embodiment, the ink cartridge 1 comprises a housing 2, an ink pack 7 (see FIG. 7 described later) housed within this housing 2, and a detection plate 50 configured to detect the ink volume of the above-described ink pack 7 provided within the housing 2. The housing 2 comprises a longwise direction, that is, a front-rear direction; a shortwise direction, that is, a vertical direction, orthogonal to the longwise direction; and a thickness direction, that is, a horizontal direction or width direction, that is orthogonal to the longwise direction and shortwise direction. Then, the housing 2 is provided with a thin and slender substantially rectangular parallelepiped shape, narrow in width and long in the front-rear direction. The ink cartridge 1, according to this example, is used with the longwise direction and thickness direction of the housing 2 substantially horizontal, and the shortwise direction substantially vertical (see FIG. 1). The substantially rectangular parallelepiped shape described here is a shape in which the general rough outer appearance is nearly rectangular parallelepiped. That is, the substantially rectangular parallelepiped shape may have a surface locally sloped with respect to the above-described longwise direction, shortwise direction, or thickness direction, or may have an odd-shaped section, such as a stepped-shaped section or the like. According to this embodiment, the housing 2, as described later, is substantially rectangular parallelepiped in shape, with a sloped lower rear wall portion 332 that connects with the left wall portion 30.

The above-described housing 2, as shown in FIG. 3, comprises a housing main body 3 and a cover 4. The housing main body 3 comprises a substantially thin, long, and narrow rectangular parallelepiped shape that fully opens on the right side, that is, on the other lateral surface on the other side in the thickness direction. The cover 4 comprises a long and narrow plate shape for covering the above-described opening. The housing main body 3 and the cover 4 are provided with an engaging hook and an engaging hole, or with an engaging pin and an engaging hole. Then, the housing is assembled by inserting these together and connecting the housing main body 3 and the cover 4 or by welding the housing main body 3 and the cover 4.

The housing main body 3 comprises a left wall portion 30, a bottom wall portion 31, an upper wall portion 32, a rear wall 33, and a front wall portion 34. The rear wall 33, as shown in FIG. 2, comprises a vertical upper rear wall portion 331 that connects with the upper wall portion 32 and the left wall portion 30, and a sloped lower rear wall portion 332 that connects with the left wall portion 30 and the bottom wall portion 31 of the housing main body 3. The bottom wall portion 31 is somewhat shorter than the upper wall portion 32, and the rear end of the bottom wall portion 31 is positioned so that it recedes toward the front side of the housing main body 3. The lower rear wall portion 332 slopes inward from the upper rear wall portion 331 toward the bottom wall portion 31. An ink volume detection opening 336 of the ink pack 7 and a plug opening 335 are respectively provided to the upper rear wall portion 331 and the lower rear wall portion 332. As shown in FIG. 4, a display portion 58 provided to the upper end of the above-described detection plate 50 faces the ink volume detection opening 336. A plug 72 provided on the rear end of the ink pack 7 faces the plug opening 335.

As shown in FIG. 3, five protruding portions, including a first rear protruding portion 301, a second rear protruding portion 302, a first intermediate protruding portion 303, a second intermediate protruding portion 304, and a front protruding portion 305, are provided by indenting the inner surface of the left wall portion 30 toward the outer surface side.

The first rear protruding portion 301 comprises the convex-shaped planar portion 316 that is parallel with the left wall portion 30. Further, the first rear protruding portion 301 is formed as a protruding portion that joins with the lower rear wall portion 332. The plug opening 335 of the above-described lower rear wall portion 332 is formed into a lateral U-shape on the lower rear wall portion 332. At this time, the plug opening 335 is formed so that the U-shaped end portion in the protruding direction extends across to the joining portion of the lower rear wall portion 332 of the first rear protruding portion 301. Note that the vicinity of the end portion of plug opening 335 on the left wall 30 side serves as a joining wall portion 337. The first rear protruding portion 301 comprises a rectangular engaging hole 307.

The second rear protruding portion 302 comprises a convex-shaped planar portion 317 that is parallel with the left wall portion 30. Further, the second rear protruding portion 302 is formed as a protruding portion that joins with the upper rear wall portion 331. The ink volume detection opening 336 of the above-described upper rear wall portion 331 forms a lateral rectangular shape from the upper rear wall portion 331 to the second protruding portion 302. The first intermediate protruding portion 303 and the second intermediate protruding portion 304 are provided in locations near the rear portion of the left wall portion 30 and are separated vertically. The front protruding portion 305 is provided in a location near the front portion of the left wall portion 30. These first and second intermediate protruding portions 303 and 304 and front protruding portion 305 each comprise convex-shaped planar portions 342, 347, and 352 that are parallel with the left wall portion 30. Gentle sloped portions 341, 346, and 351 that slope toward the rear direction are formed on the rear sides of these convex-shaped planar portions 342, 347, and 352.

The convex-shaped planar portions 316, 317, 342, 347, and 352 of these protruding portions 301, 302, 303, 304, and 305 have the same height. With this arrangement, when a worker performs a task such as installing the cover 4 or placing the ink pack 7 within the housing main body 3, the worker performs the operation with the housing main body 3 laid on a horizontal plane, such as a work table, as shown in FIG. 3. Then, the worker can stably support the housing main body 3 on the plane using the protruding portions 301 to 305 and effectively perform the task.

Note that the first and second intermediate wall portions 303 and 304 comprise an identification function that permits color identification by the user. That is, when the second intermediate wall portion 304 is short, the first intermediate wall portion 303 is long, and the condition described later is satisfied, the ink color of the ink pack 7 housed within the housing 2 is white. The condition is that the second intermediate wall portion 304 does not intersect with the strip region in the front-rear direction of the housing 2, which has a width that between the boundary location of the upper and lower rear walls 331 and 332 and the lower end location of the second rear protruding portion 302. Further, if the second intermediate wall portion 304 is long, the first intermediate wall portion 303 is short, and the second intermediate wall portion 304 intersects with the above-described strip region, the ink color of the ink pack 7 housed in the housing 2 is yellow, magenta, and cyan.

Figure 5:
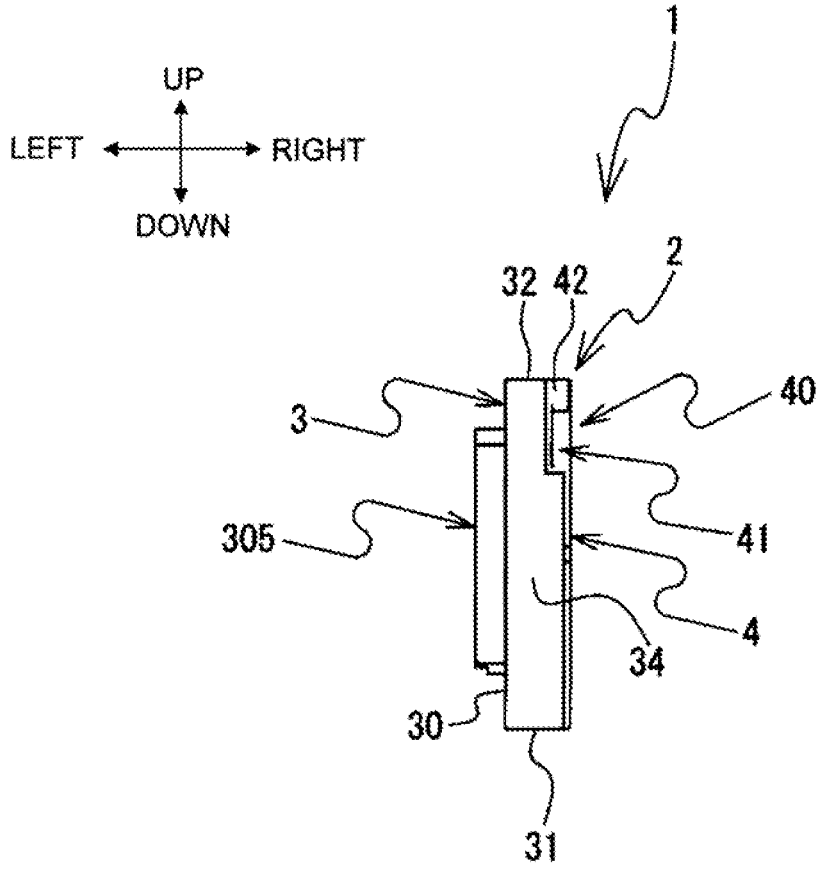
FIG. 5 is a front view of the ink cartridge.

A gripping portion 40 of the housing 2 is provided to the upper front corner portion of the cover 4, as shown in FIG. 3. The gripping portion 40 comprises a fan-shaped recessed portion 41 and a protruding portion 42. The recessed portion 41 comprises a fan-shaped surface portion 411 of an included angle of 90° that indents the upper front corner portion of the cover 4 from the outer surface side toward the inner surface side, and a peripheral wall 412. The protruding portion 42 protrudes in the direction opposite the recessed direction, near the pivot of the fan of the recessed portion 41, and comprises a length that is shorter than the depth of the recessed portion 41. The upper front corner portion of the housing main body 3, as shown in FIG. 3 and FIG. 5, cuts out the upper wall portion 32 and the front wall portion 34 to ensure reception of both sides of the fan shape on the bottom surface of the recessed portion 41, thus receiving the recessed portion 41. With such the gripping portion 40 provided to the housing 2, the worker can securely grip and easily remove the cartridge 1. For example, even in a case where a plurality of cartridges 1 is mounted with slight gaps therebetween to the cartridge mounting portion 108 of the printer 100, for example, the worker can put one of his or her fingers used to pinch both sides of the housing 2 on the gripping portion 40.

Figure 6:
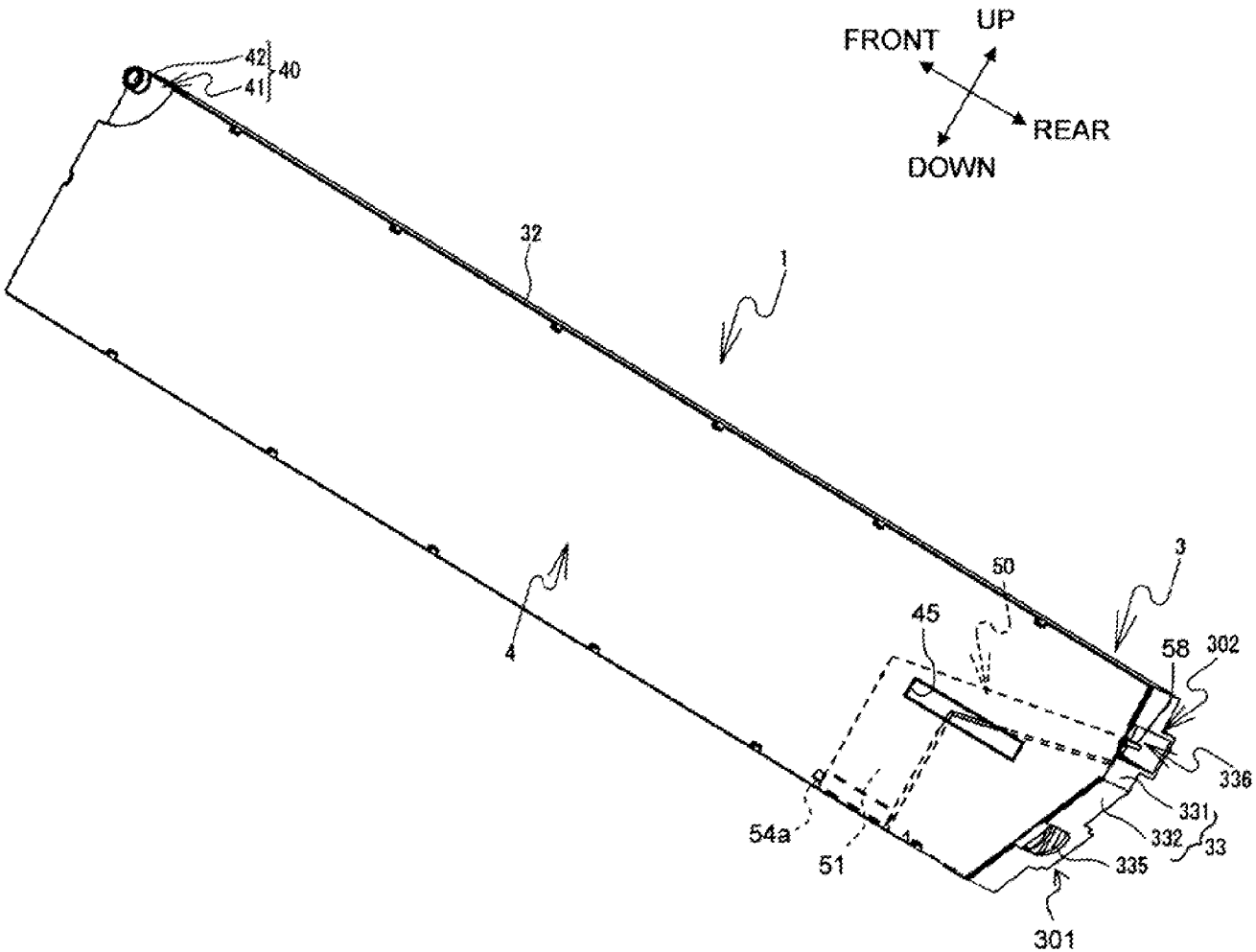
FIG. 6 is a perspective view of the ink cartridge, as viewed from the rear.

Further, an observation hole 45 that is long in the front-rear direction and passes through the cover 4 is provided at a location near the rear portion of the cover 4. As shown in FIG. 6, a part of the detection plate 50 and the ink pack 7 within the housing 2 is visible through the observation hole 45.

Ink Pack

Figure 7:
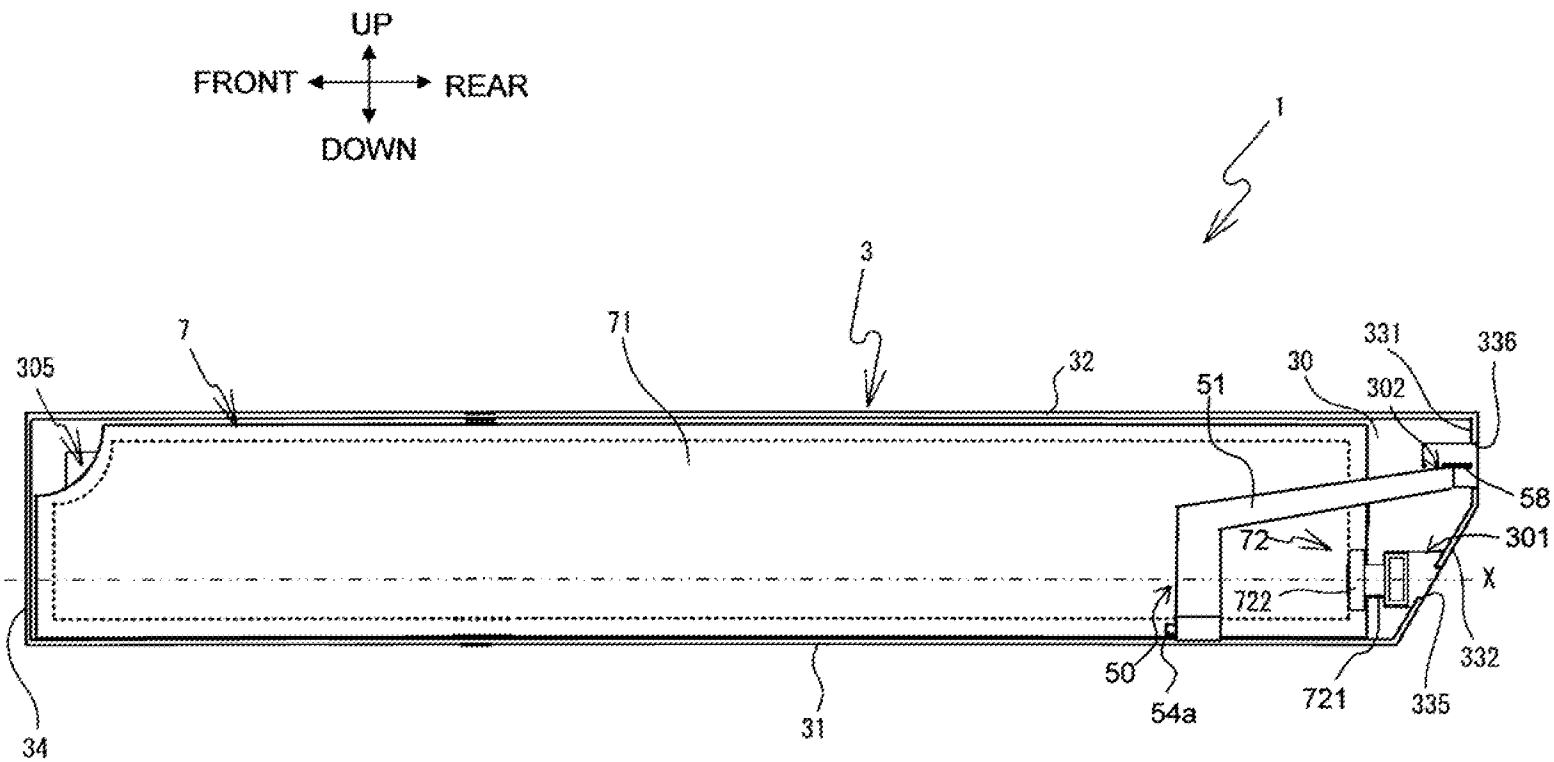
FIG. 7 is a side view showing the housing main body where the ink pack and detection plate are provided.

Next, the structure of the ink pack 7 and the surrounding area thereof will be described using FIG. 7 to FIG. 9. As shown in FIG. 7, the ink pack 7 comprises a long, narrow, bag-shaped reservoir portion 71 that stores ink, and the above-described plug 72 installed to the rear end portion of this reservoir portion 71. The reservoir portion 71 is formed by overlapping two long and narrow rectangular-shaped flexible sheets made of a transparent resin and heat-sealing a surrounding portion 716 (see FIG. 9) of the four sides thereof. The flexible sheets are configured by cutting out a front corner portion into a fan shape in accordance with the gripping portion 40 of the cover 4. The ink pack 7 is disposed within the housing 2 with the left side, that is, one side in the thickness direction, of the reservoir portion 71 contacting the left wall portion 30 of the housing main body 3.

The plug 72 comprises a resin, cylindrical main body portion 721 and a joining portion 722 that has a square cylindrical shape with a long and narrow width in the vertical direction. The cylindrical main body portion 721 is formed in a rectangular block shape having a rear side that is relatively large. The joining portion 722 is integrally provided with the front portion of the main body portion 721.

Figure 8:
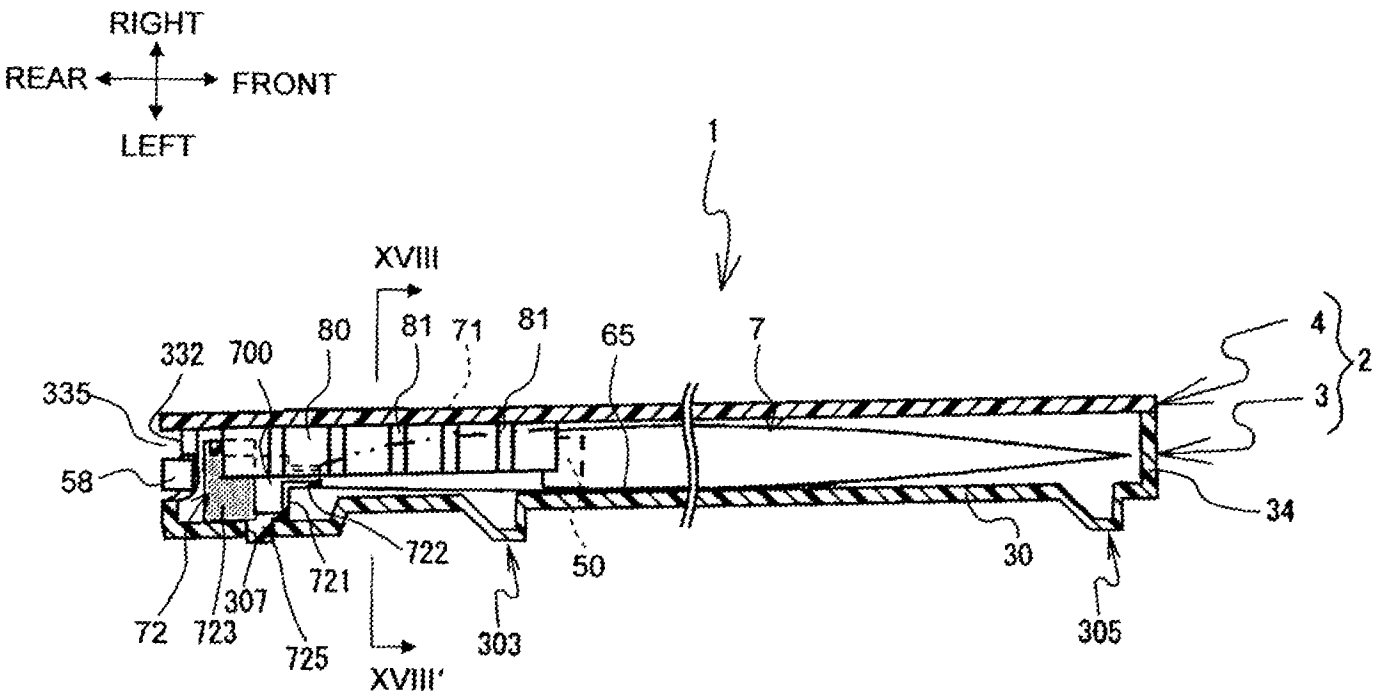
FIG. 8 is a horizontal sectional view of the ink cartridge.

The main body portion 721, as shown in FIG. 8, comprises a hollow portion 700 on the inside, which links with a small hole through which the joining portion 722 is inserted. A rubber stopper 723 that blocks the rear end portion of the hollow portion 700 is inserted into the rear portion of the main body portion 721. The joining portion 722 of the plug 72 is inserted between the two sheets that make up the reservoir portion 71 on the rear end portion of the reservoir portion 71, and heat-sealed per sheet. With this arrangement, the plug 72 is secured to the rear end portion of the reservoir portion 71 so that it is liquid tight, with an axial direction X thereof (see FIG. 7) aligned in the longwise direction, that is, the front-rear direction, of the reservoir portion 71. A prismatic joining protruding portion 725 is provided on the outer peripheral surface of the rectangular block-shaped section of the main body portion 721. The joining protruding portion 725 positions the plug 72 with respect to the housing 2, specifically with respect to the side wall portion 30 of the housing main body 3.

Note that a collapse prevention rib 80 that prevents collapse of the upper portion of the reservoir portion 71 is provided to the cover 4, extending above the detection plate 50. Furthermore, a reinforcement rib 81 that reinforces the collapse prevention rib 80 is provided to the cover 4. The collapse prevention rib 80 and the reinforcement rib 81 will be described later.

Figure 9:
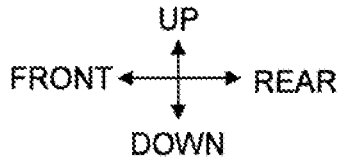
FIG. 9 is a longitudinal sectional view of the main parts, showing the rear of the cartridge mounting portion of the housing of the printer.
Figure 9:
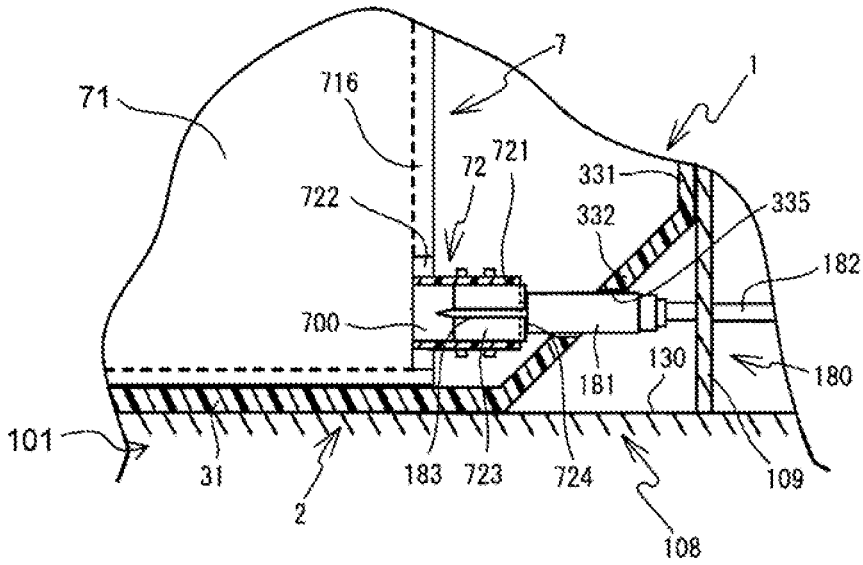

On the other hand, as shown in FIG. 9, a horizontal mounting table 130 and an abutment plate 109 are provided to the cartridge mounting portion 108 of the housing 101 of the printer 100. The mounting table 130 mounts the ink cartridge 1. The abutment plate 109 stands substantially vertically upward from the above-described mounting table 130 on the rear portion of the cartridge mounting portion 108. Further, a connecting portion 180 is provided to the rear end portion of the cartridge mounting portion 108. The connecting portion 180 is securely provided within the cartridge mounting portion 108 so that it is concentric with the plug 72, in front of the abutment plate 109. The connecting portion 180 comprises a cylindrical securing portion 181 to which an ink tube 182 is connected on the rear end, and a hollow lead needle 183 comprising a hole on the end side that protrudes frontward from the front center of the securing portion 181.

The ink cartridge 1 is inserted into the cartridge mounting portion 108, rear portion first, and set into the cartridge mounting portion 108 with the rear portion of the housing 2 in contact with the abutment plate 109. A part of the securing portion 181 of the connecting portion 180 enters the housing 2 from the plug opening 335 as the cartridge 1 is inserted. Then, the lead needle 183 of the front portion of the securing portion 181 is further inserted through the center of the rubber stopper 723 from an end portion 724 of the rubber stopper 723 of the main body portion 721 of the plug 72. As a result, the end portion of the lead needle 183 is positioned within the hollow portion 700 of the main body portion 721. With this arrangement, the reservoir portion 71 of the ink pack 7 and the ink tube 182 on the printer 100 side are connected via the plug 72 and the connecting portion 108. As a result, the ink within the reservoir portion 71 is discharged into the ink tube 182 through the hollow portion 700 of the plug 72, the lead needle 183, and the securing portion 181 of the connecting portion 108 and supplied from the ink tube 182 to the printhead 114.

Detection Plate

Figure 10:
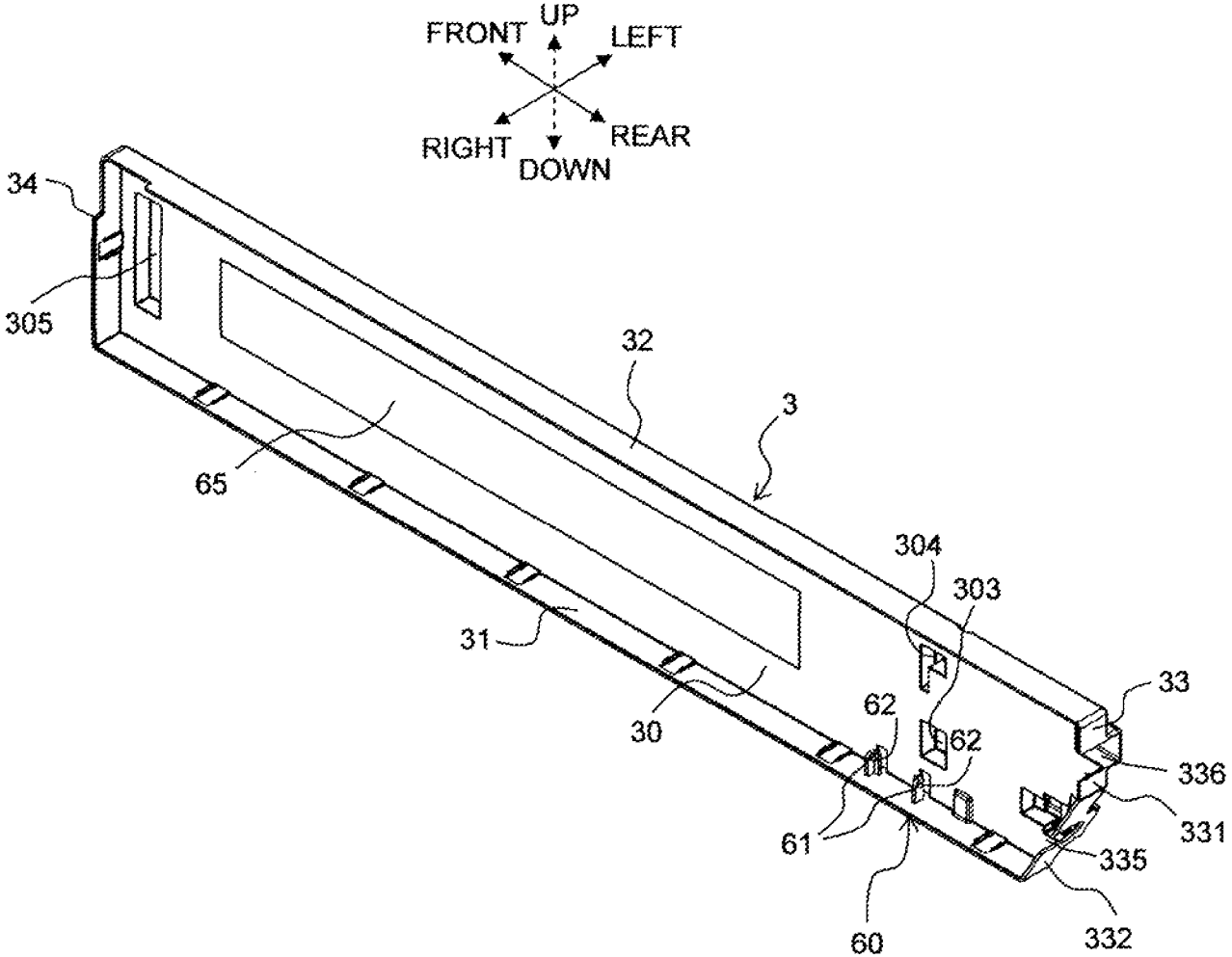
FIG. 10 is a perspective view of the ink cartridge, as viewed from the rear of the housing main body.
Figure 11:
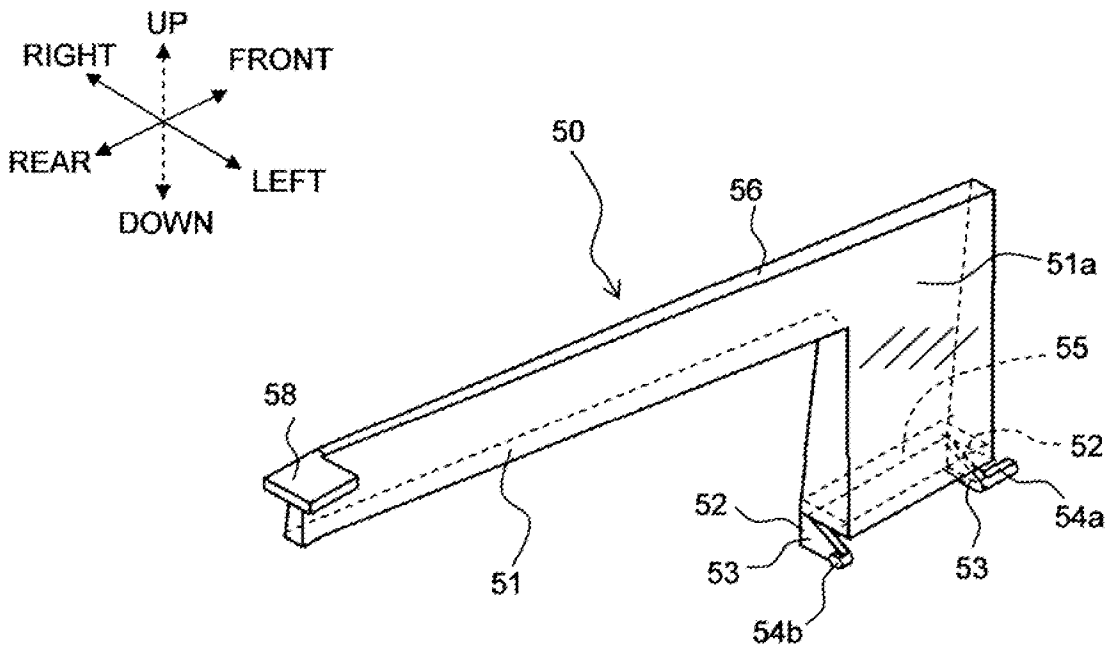
FIG. 11 is a perspective view showing the detection plate installed in the housing main body.
Figure 12A:
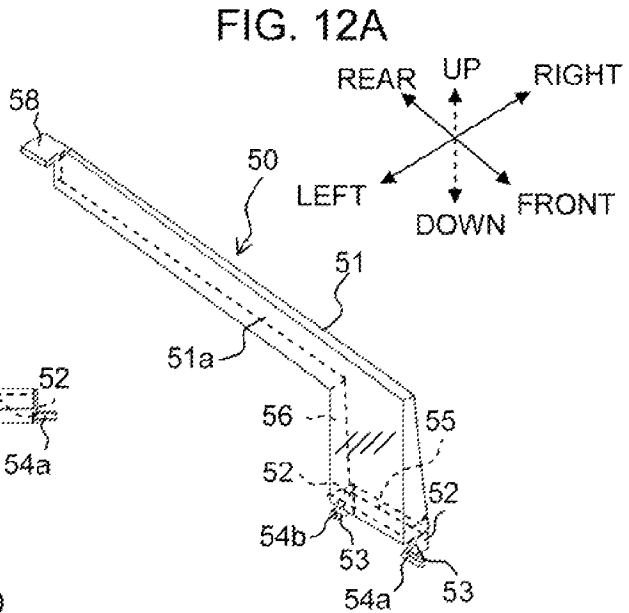
FIG. 12A is a perspective view showing the detection plate installed in the housing main body.
Figure 12B:
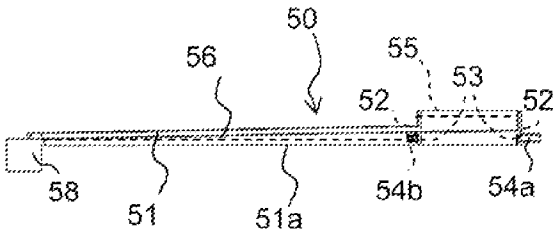
FIG. 12B is a top view showing the detection plate installed in the housing main body.
Figure 12C:
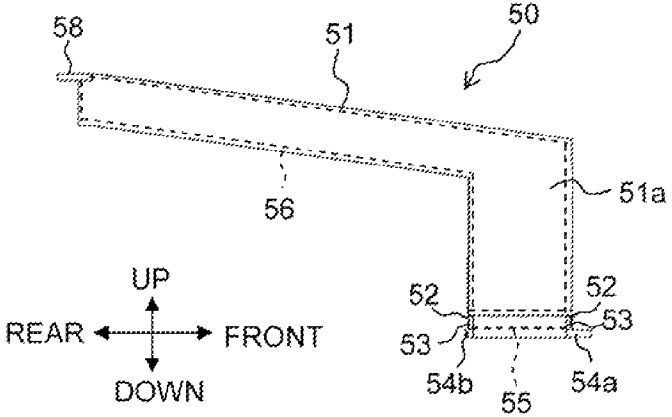
FIG. 12C is a side view showing the detection plate installed in the housing main body.

Next, the detailed structure of the detection plate 50, which is one special characteristic of this embodiment, and its installation state will be described using FIG. 10 to FIG. 14. As shown in FIG. 10, an adhesive portion 65, that is, for example, double-sided tape, is provided in a strip shape in the longwise direction to the vertical center of the left wall portion 30 of the housing main body 3, on the inner surface. The adhesive portion 65 contacts and secures the left side of the reservoir portion 71 of the ink pack 7 housed within the housing 2. The disposed area of the adhesive portion 65 is established on the inner surface area of the left wall portion 30, between the front protruding portion 305, the first intermediate protruding portion 303, and the second intermediate protruding portion 304. The disposed area of the adhesive portion 65 is outside the range of the disposed area of the detection plate 50 provided within the housing 2, specifically, further toward the front than the disposed area of the detection plate 50. A support mechanism 60 is provided near the left side of the housing 2, at the inner surface location of the bottom wall portion 31 further rearward than the provided area of the adhesive portion 65 of the housing main body 3. The support mechanism 60 rotatably supports the detection plate 50. The support mechanism 60 comprises two front and rear mounting plates 61 and 61 provided at an in interval in the longwise direction, that is, the front-rear direction, of the housing 2. Concave portions 62 and 62 which respectively engage with shaft portion 54*a* and 54*b*, that is, convex portions, provided to the detection plate 50 are provided to each of the mounting plates 61. In other words, the concave portions 62 and 62 are disposed at a predetermined interval in the axial direction of the above-described plug 72. While established as a through-hole according to this example, the concave portion 62 may be a dummy hole that opens in a direction opposite the protruding direction of the shaft portions 54*a* and 54*b* of the detection plate 50 and, if so, is given a depth deeper than at least the shaft portions 54*a* and 54*b*.

The detection plate 50, as shown in FIG. 11 and FIGS. 12A to 12C, is made of a substantially inverted L-shaped frame formed by a flexible material, which is resin according to this example. The detection plate 50 comprises an abutment plate 51 that bends into an inverted L-shape, two front and rear arm portions 52 and 52, the shaft portions 54*a* and 54*b*, the planar display portion 58, and a connecting plate 55.

A left surface 51*a* of the abutment portion 51 comes in contact with the right side of the ink pack 7. The two front and rear arm portions 52 and 52 are provided to the front side, specifically, one bent side, that is, an end portion of the lower side, that is, a lower end portion, of the abutment portion 51, and disposed at a predetermined interval in the longwise direction, that is, the front-rear direction, of the housing 2. The above-described shaft portions 54*a* and 54*b* are provided to support plates 53 of the respective arm portions 52 so that they protrude outward in the extended direction, that is, a direction that intersects the horizontal direction, that is, the front-rear direction, of the arm portions 52, and are linearly disposed at an interval. The display portion 58 is provided to the other bent side, that is, the end portion of the upper side, that is, the upper end portion, which is the rear side of the abutment plate 51. The connecting plate 55 connects the two support plates 53, firmly supporting the support plates 53.

An edge frame 56 is provided to the surrounding area, excluding one bent side, that is, the end portion on the lower side, of the abutment plate 51. The edge frame 56 protrudes to the left of the abutment plate 51, and gradually narrows along the other bent side, that is, the upper side, of the abutment plate 51. The abutment plate 51 is reinforced by the edge frame 56.

The support plate 53 is formed on the arm portion 52 in a substantially triangular shape or substantially trapezoidal shape, extending from one side, that is, the end portion area on the left side, to the other side, that is, the area on the right side, to provide higher elasticity to the arm portion 52. The arm portion 52 connects with the abutment plate 51 on the other side, that is, the area on the right side, of the support plate 53. The shaft portion 54 is provided to one side, that is, the end portion area on the left side, of the support plate 53. Then, to ensure strength during the elastic deformation of the arm portion 52, the arm portion 52 is provided so that it juts out on the other side, that is, the right side, further than the other side, that is, the right end portion, of the abutment plate 51.

Figure 13:
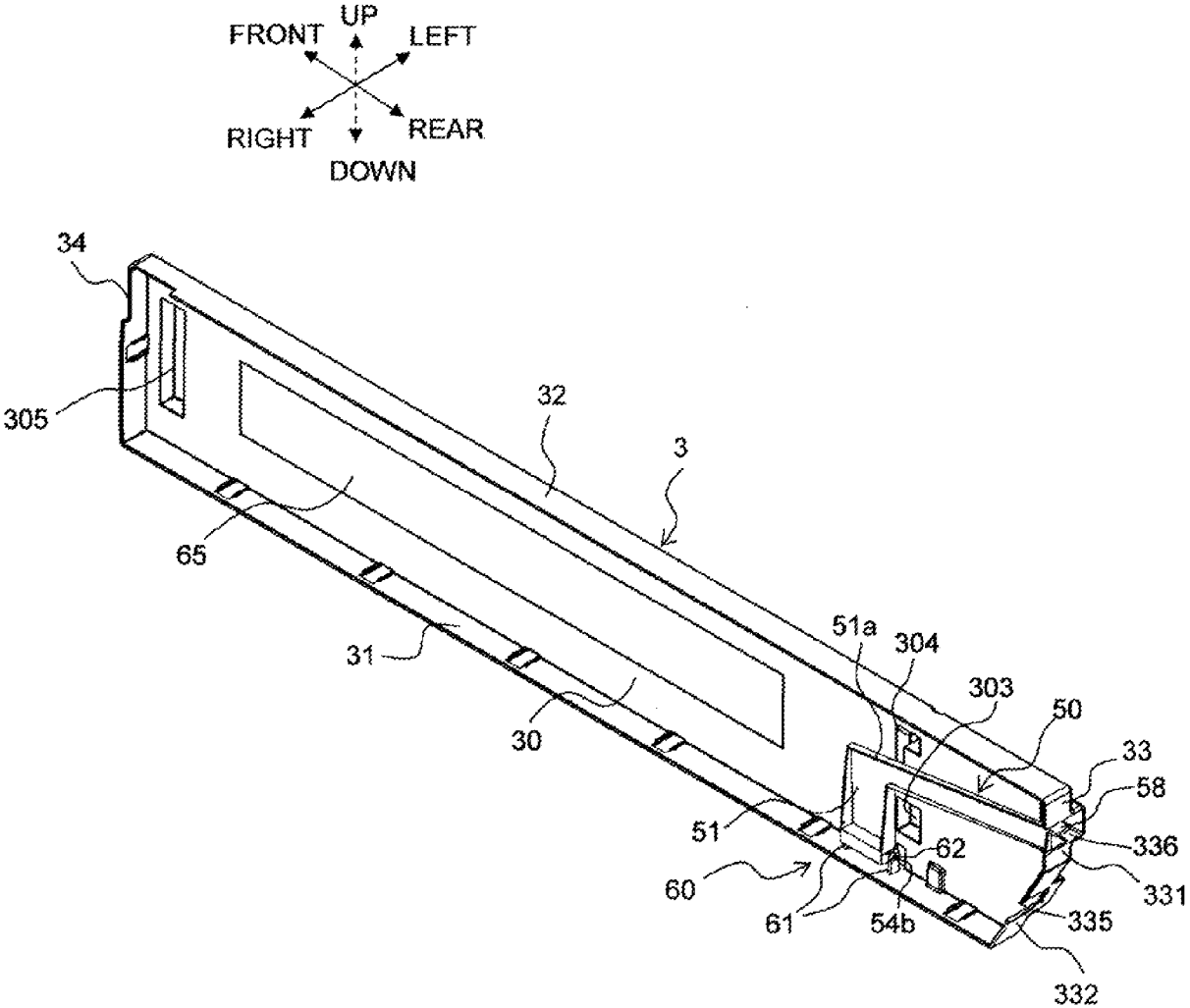
FIG. 13 is a perspective view showing the housing main body in which the detection plate is installed, as viewed from the upper left on the rear side.
Figure 14:
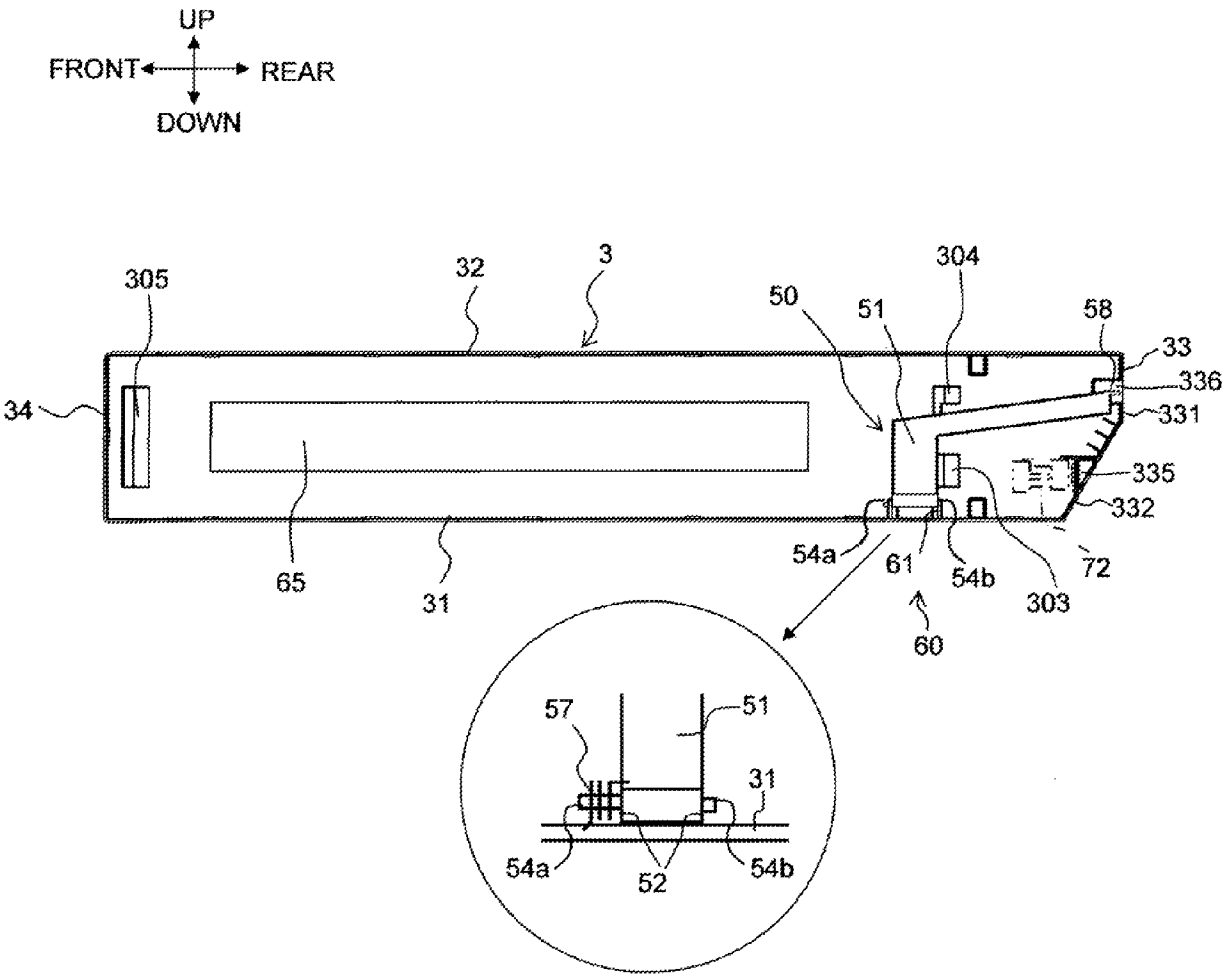
FIG. 14 is a side view showing the housing main body in which the detection plate is installed.

To install the detection plate 50 to the housing main body 3, first the left surface 51*a* of the detection plate 50 is disposed in the housing main body 3 in a state facing the left wall portion 30 of the housing main body 3, as shown in FIGS. 13 and 14. Then, force is applied by hand on at least one of the two arm portions 52 and 52, inward in the direction opposite the protruding direction of the shaft portion 54 (see FIG. 21A described later as well). Then, the area is elastically deformed to the extent that the shaft portion 54 and the above-described concave portion 62 of the mounting plate 61 of the support mechanism 60 do not engage, changing the position of the shaft portion 54 provided to the one arm portion 52. In this state, the external force is removed from the one arm portion 52, bringing the two arm portions 52 near the interval prior to deformation by the elastic force generated by external force removal, engaging the concave portion 61 and the shaft portion 54. As a result, the detection plate 50 is rotatably provided within the housing 2, and the shaft portion 54 is inserted in a position that includes the rotation center of the arm portion 52.

The protruding, that is, front-rear, length of the shaft portions 54*a* and 54*b* provided to the support plates 53 and 53 of the two arm portions 52 and 52 have a relationship such as shown in the above-described FIG. 12, according to this example. That is, the one above-described shaft portion 54*a*, which engages with the concave portion 62 of the front/rear, for example, the front mounting plate 61 of the support mechanism 60, is established longer than the other above-described shaft portion 54*b* which engages with the concave portion 62 of the other front/rear, that is, rear mounting plate 61. Note that the protruding length of the shaft portion 54 may be established in reserve of the above so that the shaft portion 54*a* that enters the concave portion 62 on the front side is shorter, and the shaft portion 54*b* that enters the concave portion 62 on the rear side is longer.

Further, a torsion spring 57 that locks both ends with the abutment plate 51 of the detection plate 50 and the bottom wall portion 31 of the housing main body 3 is installed to the longer shaft portion 54*a* of the two shaft portions 54*a* and 54*b* of the detection plate 50, as shown in the enlarged view in FIG. 14. Then, the shaft portion 54*a* is energized, orientating the abutment plate 51 toward one side of the housing main body 3 in the thickness direction, that is, toward the left wall portion 30. With this arrangement, the detection plate 50 is fixed to the adhesive portion 65 of the left wall portion 30 of the housing main body 3, and one side, that is, the left side, of the abutment plate 51 contacts the reservoir portion 71 of the ink pack 7 housed within the housing 2. As a result, the detection plate 50 rotates in the width direction, that is, the thickness direction, of the housing 2, around the shaft portion 54, in response to the bulging of the reservoir portion 71 associated with the ink volume.

The above-described display portion 58 is inserted through the ink volume detection opening 336 of the upper rear wall portion 331 of the housing main body 3 in the rear portion of the housing 2, with the detection plate 50 provided within the housing 2. The display portion 58 protrudes toward the ink volume detection opening 336 from the other bent side, that is, the end portion opposite the arm portion 52, that is, the upper end, of the detection plate 50. Then, the display portion 58 forms a planar shape that extends in the front-rear direction and width direction, that is, thickness direction, of the housing 2, within the detection opening 336. As a result, the display portion 58 becomes displaced in the substantially horizontal direction and width direction of the housing 2 within the detection opening 336 as the detection plate 50 of the ink pack 7 rotates (see FIG. 4, FIG. 8, etc.).

Detection of Display Portion

Figure 15:
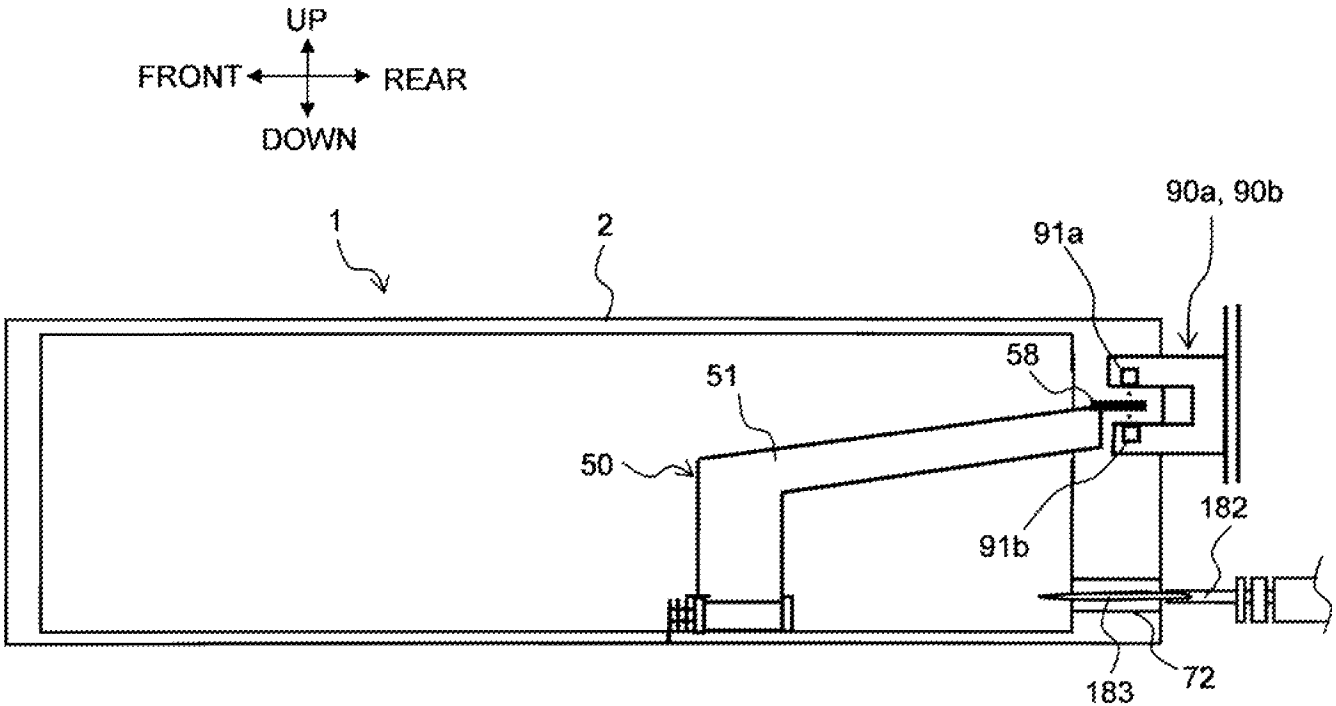
FIG. 15 is an explanatory view showing the installation of the optical sensor of the ink volume detection device to the rear end side of the cartridge mounting portion of the housing of the printer.

At this time, the displacement of the above-described display portion 58 in the substantially horizontal direction is detected on the printer 100 side. Detection of this displacement will now be described using FIG. 15 and FIG. 16. As shown in FIG. 15, a first sensor 90*a* and a second sensor 90*b* of an optical form are provided as ink volume detection devices to a vertical position corresponding to the display portion 58 of the detection plate 50, on the rear end side of the cartridge mounting portion 108 of the housing 101 of the printer 100. The first sensor 90*a* and the second sensor 90*b* are provided in parallel in the width direction of the housing 2. The first sensor 90*a* and the second sensor 90*b* are light-transmitting sensors comprising a light emitter 91*a* and a light receptor 91*b* at upper and lower locations with the display portion 58 therebetween. As shown by the white arrow, the display portion 58 is displaced in the width direction, that is, the horizontal direction, of the housing 2, blocking the light emitted from the light emitter 91*a* toward the light receptor 91*b*. Then, the first sensor 90*a* and the second sensor 90*b* each change from an ON state in which the light receptor 91*b* receives light to an OFF state. A detection signal corresponding to this ON state or OFF state of the first sensor 90*a* and the second sensor 90*b* is inputted to a CPU (not shown) of the printer 100. The CPU is capable of determining the ink volume within the reservoir portion 71 of the ink pack 7 based on four levels, in accordance with the detection signal from the first sensor 90*a* and the second sensor 90*b*.

That is, when there is a high volume of ink within the reservoir portion 71, the reservoir portion 71 has sufficient thickness in the width direction, that is, the horizontal direction, and the display portion 58 of the detection plate 50 is positioned near the left side. In this case, as shown in FIG. 16A which simplifies the relationship between the display portion 58, the first sensor 90*a*, and the second sensor 90*b* as viewed from above, only the first sensor 90*a* of the first sensor 90*a* and the second sensor 90*b* which is positioned on the left side turns OFF. As a result, as shown in FIG. 16E, the ink volume of the reservoir portion 71 is determined as full.

From the above-described state, the display portion 58 of the detection plate 50 moves slightly near the right side as the ink volume within the reservoir portion 71 slightly decreases. In this case, as shown in FIG. 16B, both the first sensor 90*a* and the second sensor 90*b* turn OFF. As a result, as shown in FIG. 16E, the ink volume of the reservoir portion 71 is determined as not full but still sufficient.

Subsequently, the display portion 58 of the detection plate 50 further moves further near the right side as the ink volume within the reservoir portion 71 further decreases. In this case, as shown in FIG. 16C, the first sensor 90*a* turns ON and the second sensor 90*b* turns OFF. As a result, as shown in FIG. 16E, the ink volume of the reservoir portion 71 is determined as close to empty.

Subsequently, the display portion 58 of the detection plate 50 moves further near the right side as the ink volume within the reservoir portion 71 further decreases, coming close to empty. In this case, as shown in FIG. 16D, both the first sensor 90*a* and the second sensor 90*b* turn ON. As a result, as shown in FIG. 16E, the ink volume of the reservoir portion 71 is determined as empty.

The above-described CPU of the printer 100 issues notifications and prohibits printing in accordance with the ink volume, based on the above-described determination results.

Collapse Prevention Rib

Next, the above-described collapse prevention rib 80, which is one more special characteristic of this embodiment, will be described using FIGS. 17 to 19.

Figure 17:
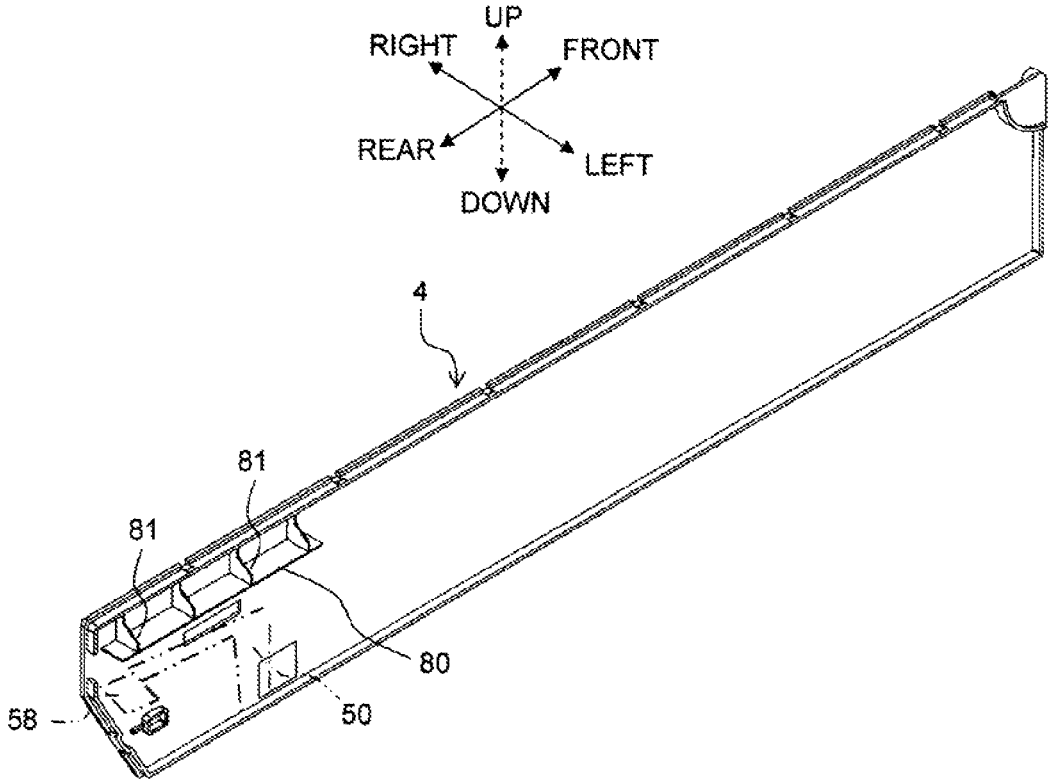
FIG. 17 is a perspective view of the cover of the housing of the ink cartridge, as viewed from the rear.
Figure 18:
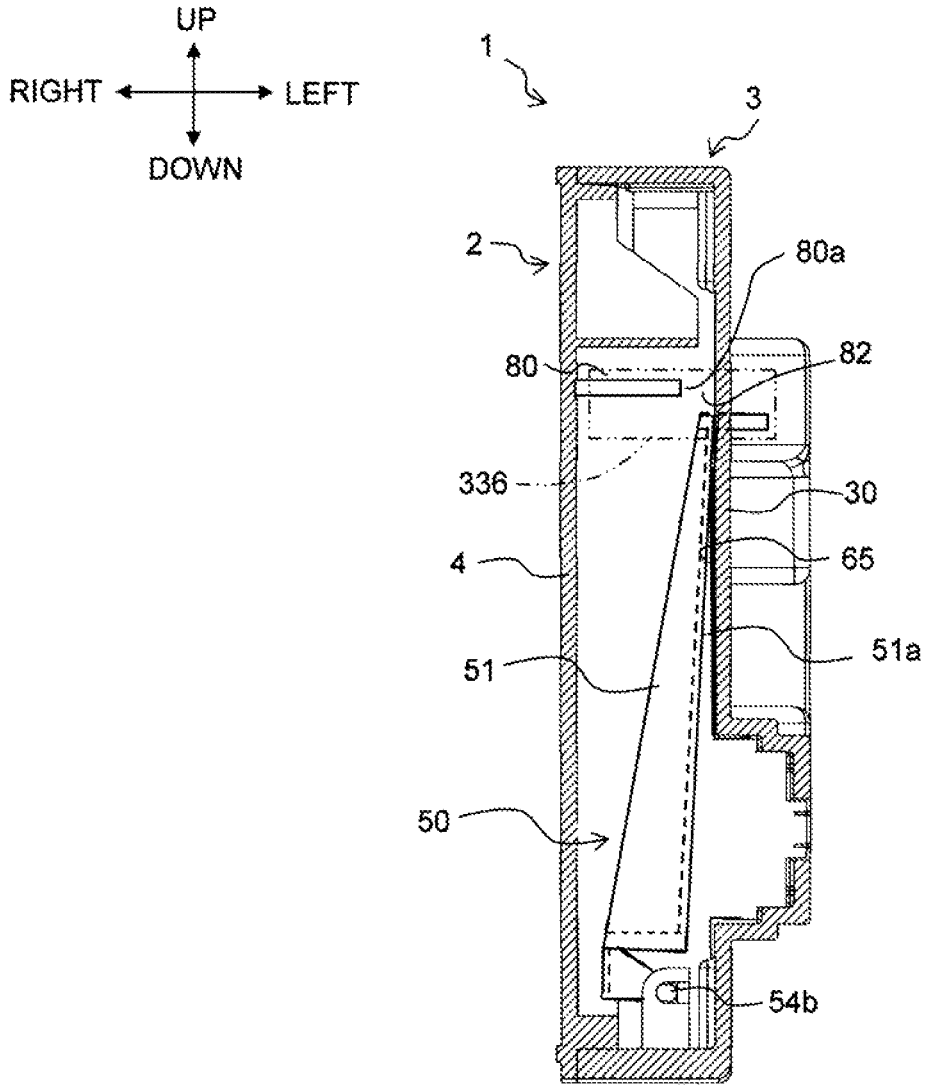
FIG. 18 is a cross-sectional view showing the cross-sectional structure of the cross-section XVIII-XVIII' of FIG. 8, with the ink pack removed.

As shown in FIGS. 17 to 19, the above-described collapse prevention rib 80 which prevents the collapse of the reservoir portion 71 of the ink pack 7, and the above-described reinforcement rib 81 which reinforces the collapse prevention rib 80 are provided to the upper inner surface of the cover 4, on the rear portion. The collapse prevention rib 80 is established on the upper inner surface of the cover 4, on the rear portion. Further, the collapse prevention rib 80 creates a predetermined gap 82 between a left end portion 80*a* and the left lateral surface of the housing 2, that is, with the left wall portion 30 of the housing main body 3, and extends substantially horizontally above the detection plate 50. This collapse prevention rib 80 is positioned further rearward than the rear end portion of the adhesive portion 65 previously described (see FIG. 3 and FIG. 10 as well). Further, the vertical position of the collapse prevention rib 80 is further upward than the vertical position of the upper end portion of the adhesive portion 65 of the left wall portion 30 (see FIG. 18). The reinforcement rib 81 extends substantially vertically so that it intersects with the collapse prevention rib 80 in at least one location, in four locations in this example, in the substantially horizontal direction of the collapse prevention rib 80 that extends substantially horizontally. The reinforcement rib 81 connects the collapse prevention rib 80 and the right lateral surface of the housing 2, that is, the cover 4.

Figures 19A, 19B, 19C:
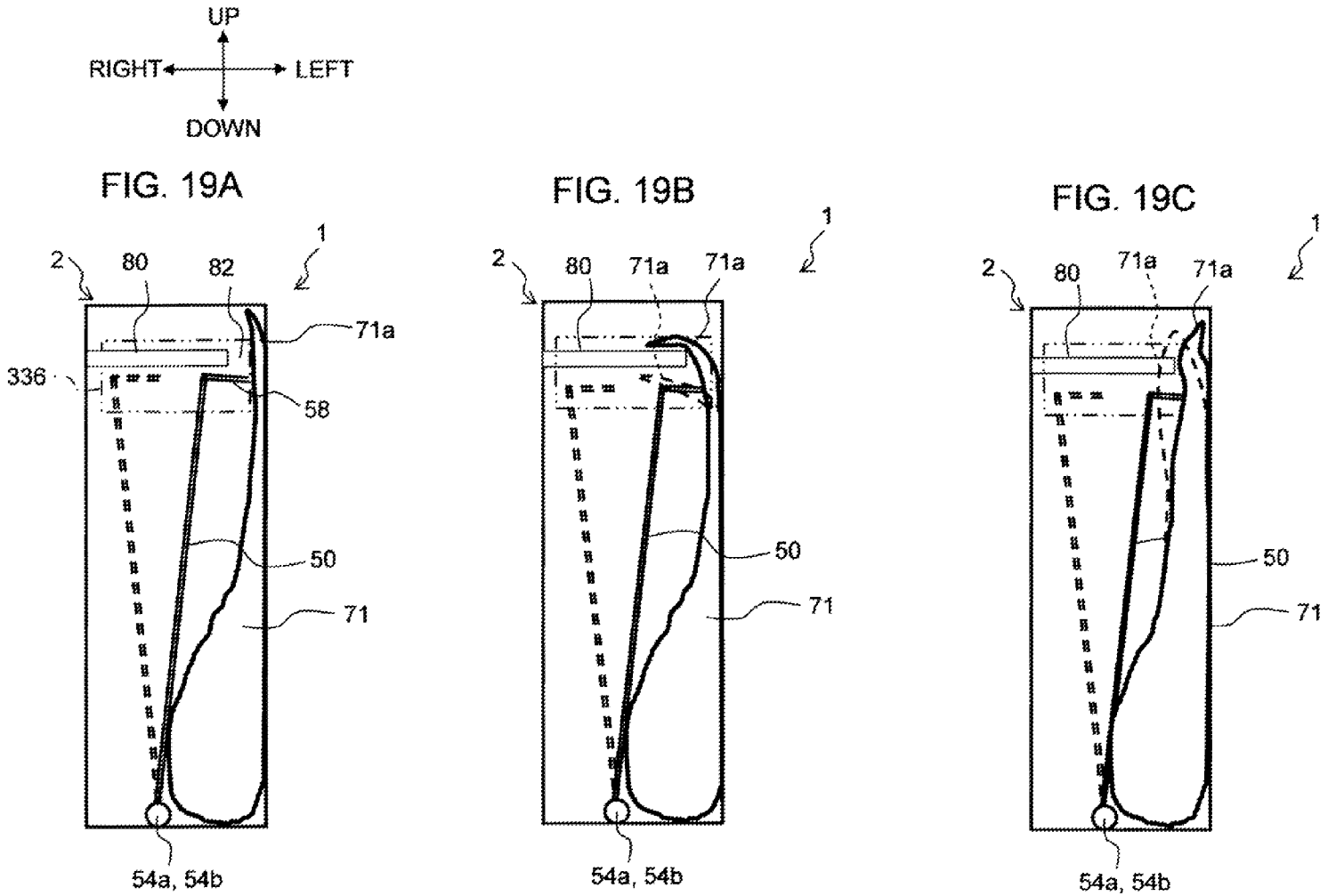
FIG. 19A is an explanatory view showing the action of the collapse prevention rib provided to the housing.
FIG. 19B is an explanatory view showing the action of the collapse prevention rib provided to the housing.
FIG. 19C is an explanatory view showing the action of the collapse prevention rib provided to the housing.

The reservoir portion 71 of the ink pack 7 contacts and is fixed by the adhesive portion 65 of the left wall portion 30. As shown in FIG. 19A, an upper portion 71*a* of the reservoir portion 71 is inserted through the gap 82. When the ink volume decreases in the interior as a result of ink usage, decreasing the ink level, the interior of the upper portion 71*a* of the reservoir portion 71 becomes empty, as shown in the above-described FIG. 19A. In this case, the upper portion 71*a* that has become empty may collapse or hang downward toward the right due to the elasticity of the bag of the reservoir portion 71, changing from the dashed-line state to the solid line state in FIG. 19B. In such a case, the collapsed upper portion 71*a* may contact the detection plate 50, causing the display of the ink volume by the rotational position associated with the ink volume of the detection plate 50 to become inaccurate.

According to this embodiment, the collapse prevention rib 80 is provided in response to the above. Further, the upper portion 71*a* of the reservoir portion 71 is inserted through the gap 82 formed between the collapse prevention rib 80 and the left lateral surface of the housing 2, that is, with the left wall portion 30 of the housing main body 3. With this arrangement, even if the upper portion 71*a* of the reservoir portion 71 attempts to collapse downward toward the right, the collapse prevention rib 80 receives and stops the upper portion 71*a* as shown in FIG. 19B, suppressing further displacement of the reservoir portion 71 to the right. Further, as shown in FIG. 19C, the collapse prevention rib 80 also suppresses the upper area of the reservoir portion 71 from bulging, deforming, and contacting the detection plate 50.

Figure 20A:
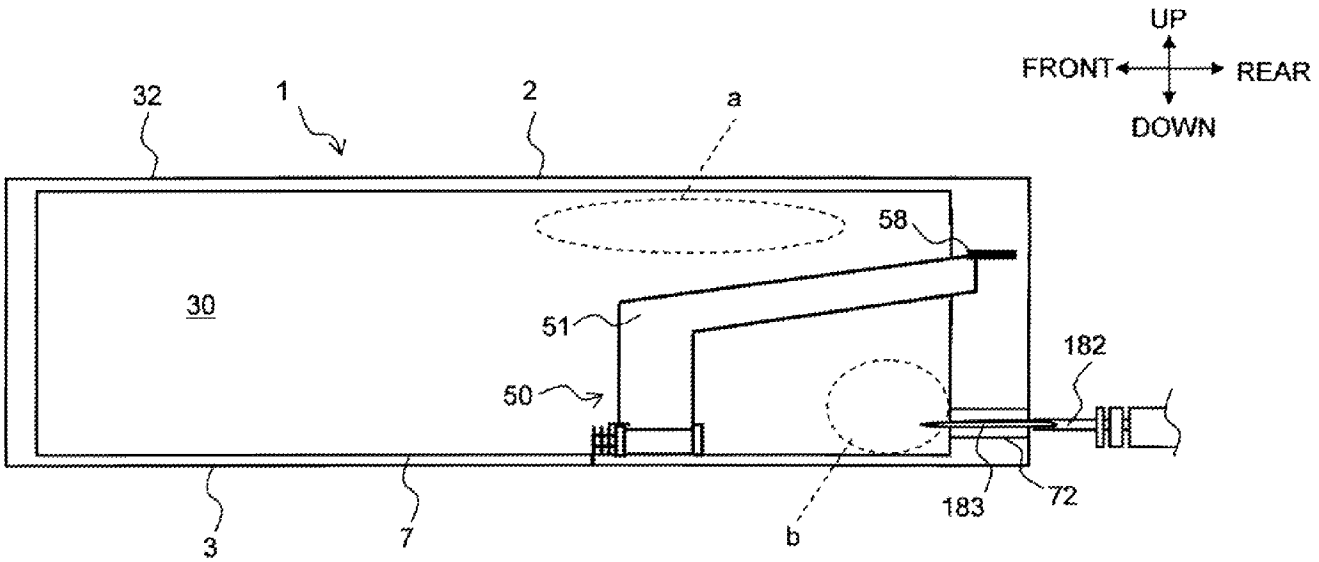
FIG. 20A is an explanatory view showing an inappropriate location for installation of the detection plate within the housing.
Figure 20B:
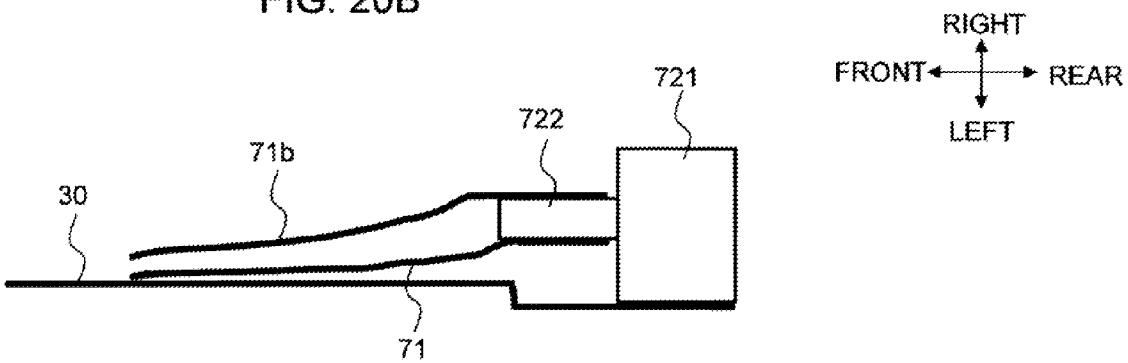
FIG. 20B is an explanatory view showing an inappropriate location for installation of the detection plate within the housing.

Note that, at this time, as shown in FIG. 20A which is a side view of the interior of the housing 2, the ink volume of the reservoir portion 71 cannot be properly detected in a case where the detection plate 50 is provided so that the abutment plate 51 contacts the reservoir portion 71 at an upper location A near the rear, that is, at a location near the upper wall portion 32 near the rear portion of the housing main body 3. Further, also in a case where the abutment plate 51 is made to contact the reservoir portion 71 at a location B near the plug 72 of the ink pack 7 of FIG. 20A, similarly the residual ink volume cannot be accurately detected. This is due to the structure of the joining portion 722 that is heat-sealed to the sheets of the reservoir portion 71 and the above-described main body portion 721 that fixes the plug 72 to the housing 2, and the positional relationship with the reservoir portion 71, as shown in FIG. 20B, which is a view of the housing 2 from the lower side. That is, as a result of the above-described structure and above-described positional relationship, a right lateral surface 71*b* of the reservoir portion 71 has a certain positional relationship, regardless of the residual ink volume within the reservoir portion 71. Consequently, the detection plate 50 is preferably provided in a form that avoids contact of the abutment plate 51 with reservoir portion 71 at the above-described locations A and B.

As described above, in the ink cartridge of this embodiment, a collapse prevention rib 80 is provided above the detection plate 50, and the upper portion 71*a* of the reservoir portion 71 is inserted through the gap 82. With this arrangement, even in a case where the upper portion 71*a* of the reservoir portion 71 collapses to the right and downward as previously described, it is possible to suppress the displacement of the reservoir portion 71 to the right (see FIG. 19B). At this time, the reservoir portion 71 is inserted through the gap 82 without getting caught and fixed between the collapse prevention rib 80 and the housing 2. With this arrangement, it is possible to ensure smooth bulging without inhibiting the bulging behavior on the above-described right of the reservoir portion 71 (see FIG. 19A) in a case where a relatively high volume of ink exists within the reservoir portion 71, resulting in a high ink level. As a result of the above, regardless if the ink volume within the reservoir portion 71 is high or low, the detection plate 50 can accurately display the ink volume by its rotational position associated with the ink volume.

Further, in particular, according to this embodiment, the housing 2 comprises the ink volume detection opening 336 on the rear lateral surface, that is, the upper rear wall 331 of the housing main body 3. Further, the display portion 58 that is displaced substantially horizontally in the same manner as the movement of the reservoir portion 71 is provided at the rear end portion of the detection plate 50, responding in accordance with the reservoir portion 71 that bulges and shrinks substantially horizontally according to the high or low volume of ink. Then, this display portion 58 is inserted and disposed through the detection opening 336. With this arrangement, the ink volume can be displayed in a manner that is instinctively easy-to-understand by the operator. Further, the collapse prevention rib 80 extends substantially horizontally along the reservoir portion 71 that bulges and shrinks substantially horizontally as described above, making it possible to not inhibit the behavior of the reservoir portion 71.

Further, in particular, according to this embodiment, the reservoir portion 71 is in contact with and fixed to the housing by the adhesive portion 65 provided to the range of the housing 2 in the front-rear direction in which the detection plate 50 is not disposed. With this arrangement, the detection plate 50 comes in contact with the reservoir portion 71 in a section that is not fixed to the housing 2 by the adhesive portion 65, that is, in an area that is capable of freely bulging and shrinking without restriction by the housing 2. As a result, the rotational position of the detection plate 50 more accurately reflects the bulging state of the reservoir portion, making it possible to more accurately display the change in ink volume with the detection plate 50.

Further, in particular, according to this embodiment, the collapse prevention rib 80 is positioned further rearward than the rear end portion of the adhesive portion 65. This has the following significance. That is, according to this embodiment, the collapse prevention rib 80 is positioned further rearward than the rear end portion of the adhesive portion 65, and thus the detection plate 50 comes in contact with the reservoir portion 71 in an area where the reservoir portion 71 is capable of freely bulging and shrinking without restriction by the housing 2. As a result, the change in ink volume is more accurately displayed. However, because the reservoir portion 71 is not fixed to the housing 2 in this area, this area is particularly susceptible to the above-described collapse, hanging, etc., when the ink volume decreases. Here, according to this embodiment, the collapse prevention rib 80 is provided to this area, making it possible to prevent the above-described collapse.

Further, in particular, according to this embodiment, the vertical position of the collapse prevention rib 80 is set further upward than the vertical position of the upper end portion of the above-described adhesive portion 65. This design has significance such as follows. That is, the area above the upper end portion of the adhesive portion 65 of the reservoir portion 71 is free of restriction without being secured to the housing 2. Accordingly, in the area of the reservoir portion 71 where the height position is above the upper end portion of the adhesive portion 65, displacement occurs relatively easily compared to other areas. As a result, the above-described collapse, hanging, etc., when the ink volume decreases tend to readily occur. Here, according to this embodiment, the collapse prevention rib 80 is provided in accordance with the height position of the area, making it possible to further improve the above-described collapse prevention effect.

Further, in particular, according to this embodiment, the strength reinforcement rib 81 extends substantially vertically so that it intersects the collapse prevention rib 80 at at least one location in the substantially horizontal direction of the collapse prevention rib 80. Then, the reinforcement rib 81 connects the collapse prevention rib 80 and the right lateral surface of the housing 2. With this arrangement, it is possible to improve the rigidity of the collapse prevention rib 80 itself as well as the rigidity of the of the installation structure of the collapse prevention rib 80 to the housing 2.

Figure 21A:
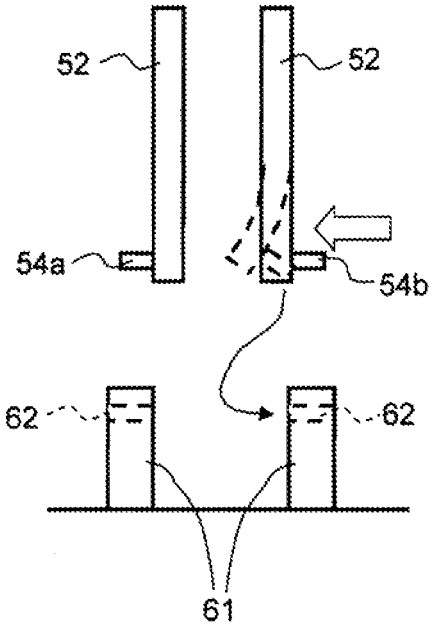
FIG. 21A is an explanatory view explaining the installation method of the shaft portion when the shaft portion of the detection plate is installed in the concave portion of the support device.
Figure 21B:
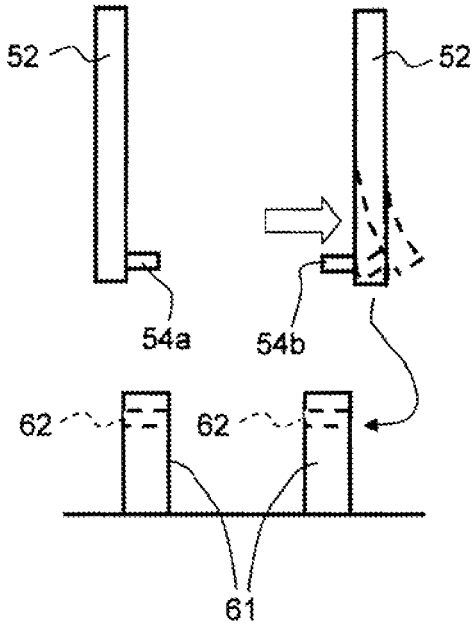
FIG. 21B is an explanatory view explaining the installation method of the shaft portion in a modification example in which the shaft portion of the detection plate is made to protrude inward.

Note that while, according to this embodiment, the shaft portions 54*a* and 54*b* of the arm portions 52 of the detection plate 50 are made to protrude outward in a direction that intersects with the extending direction of the arm portions 52, as schematically shown in FIG. 21A, the present invention is not limited thereto. That is, as shown in FIG. 21B, the shaft portions 54*a* and 54*b* may be made to protrude inward in a direction that intersects the extending direction of the arm portions 52. In this case, an external force may be applied to at least one of the arm portions 52 in the outward direction opposite the protruding direction of the shaft portions 54*a* and 54*b* for engagement with the concave portion 62 of the mounting plate 61 of the support mechanism 60.

Figure 22:
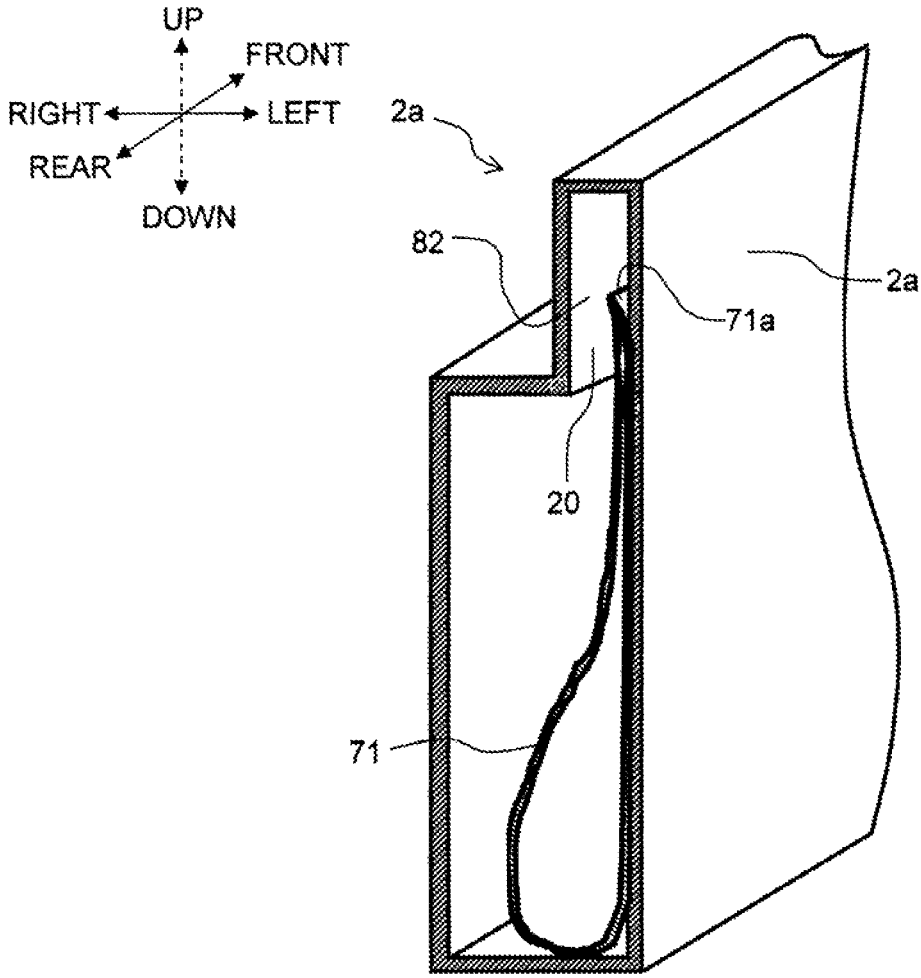
FIG. 22 is a perspective view showing a cutaway of the housing in a modification example in which a lateral surface having a cutout portion cut out into an L-shape serves as the displacement suppressing portion.

Further, while the collapse prevention rib 80 is provided as a displacement suppressing portion of the ink pack 7 within the housing 2 according to this embodiment, the present invention is not limited thereto. That is, as shown in FIG. 22, the housing 2A may be formed with at least the upper portion on the rear side of the substantially rectangular parallelepiped shape comprising a longwise direction, shortwise direction, and thickness direction cut out into an L-shape. In such a case, at least a section of the housing 2A located in the area where the detection plate 50 is disposed, that is, a lateral surface 20 in the same direction as the above-described shortwise direction where the above-described predetermined gap 82 is created with a lateral surface 2*a* on the left side of the housing 2A, can be established as the displacement suppressing portion of the ink pack 7.

Note that while, according to this embodiment, the collapse prevention rib 80 extends substantially horizontally as described above, it may slope upward or downward, etc.

Additionally, other than those previously described, methods according to the above-described embodiments and modification examples may be utilized in combination as appropriate.

Note that various modifications which are not described in particular can be made according to the present invention without departing from the spirit and scope of the invention.

What is claimed is:

1. An ink cartridge comprising:

a housing having a longwise direction, a shortwise direction orthogonal to said longwise direction, and a thickness direction respectively orthogonal to said longwise direction and said shortwise direction; and a substantially bag-shaped reservoir portion configured to store ink in its interior, disposed within said housing so that an end portion on one side in said thickness direction contacts said housing; wherein:

said ink cartridge is for supplying said ink and is used in a posture where said longwise direction and said thickness direction are substantially horizontal, and said shortwise direction is substantially vertical;

said ink cartridge further comprising:

a rotating member that is rotatably supported with respect to said housing at a lower end portion, comes in contact with the other side of said reservoir portion in said thickness direction, and rotates in accordance with an ink volume within said reservoir portion, thus executing a display in accordance with the ink volume by that rotational position; and a displacement suppressing portion that creates a predetermined gap between the end portion on the one side in said thickness direction and a lateral surface on one side of said housing in said thickness direction and extends above said rotating member, causing an upper portion of said reservoir portion to be inserted through said gap, thereby suppressing displacement of said reservoir portion to the other side in said thickness direction.

2. The ink cartridge according to claim 1, wherein:

said housing has an opening on a lateral surface on one side of said housing in said longwise direction; and said rotating member has a display portion that is disposed through said opening and is displaced substantially horizontally in accordance with the ink volume within said reservoir portion by said rotation, on an end portion on one side in said longwise direction.

3. The ink cartridge according to claim 1, wherein:

said housing is formed so that a shape of at least an area where said rotating member is disposed in a substantially rectangular parallelepiped shape having said longwise direction, said shortwise direction, and said thickness direction is cut out into an L-shape including a lateral surface in the same direction as said shortwise direction where said predetermined gap is created with the lateral surface on the one side of said housing in said thickness direction; and said lateral surface of the same direction as said shortwise direction of said housing functions as said displacement suppressing portion.

4. The ink cartridge according to claim 1, wherein:

said reservoir portion is in contact with and fixed to said housing by an adhesive portion provided in a range of said housing in said longwise direction where said rotating member is not disposed.

5. The ink cartridge according to claim 4, wherein:

said rotating member is disposed in said housing further on the one side in said longwise direction than an end portion on one side of said adhesive portion in said longwise direction; and said displacement suppressing portion is positioned further on the one side in said longwise direction than the end portion on the one side of said adhesive portion in said longwise direction.

6. The ink cartridge according to claim 4, wherein:

said displacement suppressing portion is disposed so that a vertical position of said displacement suppressing portion is further upward than a vertical position of an upper end portion of said adhesive portion.

7. The ink cartridge according to claim 1, wherein:

said housing is formed in a substantially rectangular parallelepiped shape having said longwise direction, said shortwise direction, and said thickness direction; and said displacement suppressing portion extends substantially horizontally toward the one side of said housing in said thickness direction from a lateral surface on the other side of said housing in said thickness direction.

8. The ink cartridge according to claim 7, further comprising:

a strength reinforcement portion that extends substantially vertically so that it intersects with said displacement suppressing portion at at least one location in the substantially horizontal direction of said displacement suppressing portion that extends substantially horizontally, connecting said displacement suppressing portion and the lateral surface on the other side of said housing in said thickness direction.

* * * * *